US012060730B2

(12) United States Patent
Zhao et al.

(10) Patent No.: US 12,060,730 B2
(45) Date of Patent: Aug. 13, 2024

(54) EARTHQUAKE-RESISTANT AND SEISMIC-DAMPING MULTIFUNCTION COOPERATIVE SYSTEM FOR MODULAR STEEL STRUCTURE BUILDING

(71) Applicant: SOUTH CHINA UNIVERSITY OF TECHNOLOGY, Guangzhou (CN)

(72) Inventors: Junxian Zhao, Guangzhou (CN); Zhiqiu He, Guangzhou (CN); Qixiang Tian, Guangzhou (CN)

(73) Assignee: SOUTH CHINA UNIVERSITY OF TECHNOLOGY, Guangzhou (CN)

( * ) Notice: Subject to any disclaimer, the term of this patent is extended or adjusted under 35 U.S.C. 154(b) by 0 days.

(21) Appl. No.: 18/283,455

(22) PCT Filed: Mar. 17, 2023

(86) PCT No.: PCT/CN2023/082360

§ 371 (c)(1),
(2) Date: Sep. 22, 2023

(65) Prior Publication Data

US 2024/0167293 A1 May 23, 2024

(30) Foreign Application Priority Data

Nov. 22, 2022 (CN) ..... 202211466272.1

(51) Int. Cl.
*E04H 9/02* (2006.01)

(52) U.S. Cl.
CPC ..... *E04H 9/021* (2013.01); *E04H 9/024* (2013.01)

(58) Field of Classification Search
CPC ..... E04H 9/024; E04H 9/021; E04H 9/0215; E04H 9/023; E04B 1/98; E04B 1/985
See application file for complete search history.

(56) References Cited

FOREIGN PATENT DOCUMENTS

CN 107675802 2/2018
CN 207453605 6/2018
(Continued)

OTHER PUBLICATIONS

"International Search Report (Form PCT/ISA/210) of PCT/CN2023/082360," mailed on Jun. 21, 2023, pp. 1-4.
(Continued)

*Primary Examiner* — Babajide A Demuren
(74) *Attorney, Agent, or Firm* — JCIPRNET

(57) ABSTRACT

The present invention provides an earthquake-resistant and seismic-damping multifunction cooperative system for a modular steel structure building, including a building-integrated module and connection joints between building modules. The building-integrated module includes a plurality of building modules. Each building module includes ceiling beams, local high-strength module columns and local high-strength module bottom beams. A cantilever beam section and a middle beam section of the ceiling beam are connected through a ceiling beam rotational friction joint. The connection joints between building modules include vertical building module connection joints, hinge joints between horizontal building modules and frictional connections between horizontal building modules. The adjacent building modules in a vertical direction are connected through the vertical building module connection joint, and the adjacent building modules in a horizontal direction are hinged through the hinge joint between horizontal building modules and connected through the frictional connection between horizontal building modules.

16 Claims, 22 Drawing Sheets

(56) References Cited

FOREIGN PATENT DOCUMENTS

| | | | | |
|---|---|---|---|---|
| CN | 109680819 | | | 4/2019 |
| CN | 109736444 | | | 5/2019 |
| CN | 109914593 | | | 6/2019 |
| CN | 109914631 | | | 6/2019 |
| CN | 113107251 | | | 7/2021 |
| CN | 114215213 | | | 3/2022 |
| CN | 114232793 | | | 3/2022 |
| CN | 115680127 | | | 2/2023 |
| CN | 116950260 | A | * | 10/2023 |
| CN | 117266379 | A | * | 12/2023 |
| IN | 113152974 | | | 7/2021 |
| JP | H11269984 | | | 10/1999 |

OTHER PUBLICATIONS

"Written Opinion of the International Searching Authority (Form PCT/ISA/237) of PCT/ CN2023/082360," mailed on Jun. 21, 2023, pp. 1-4.

* cited by examiner

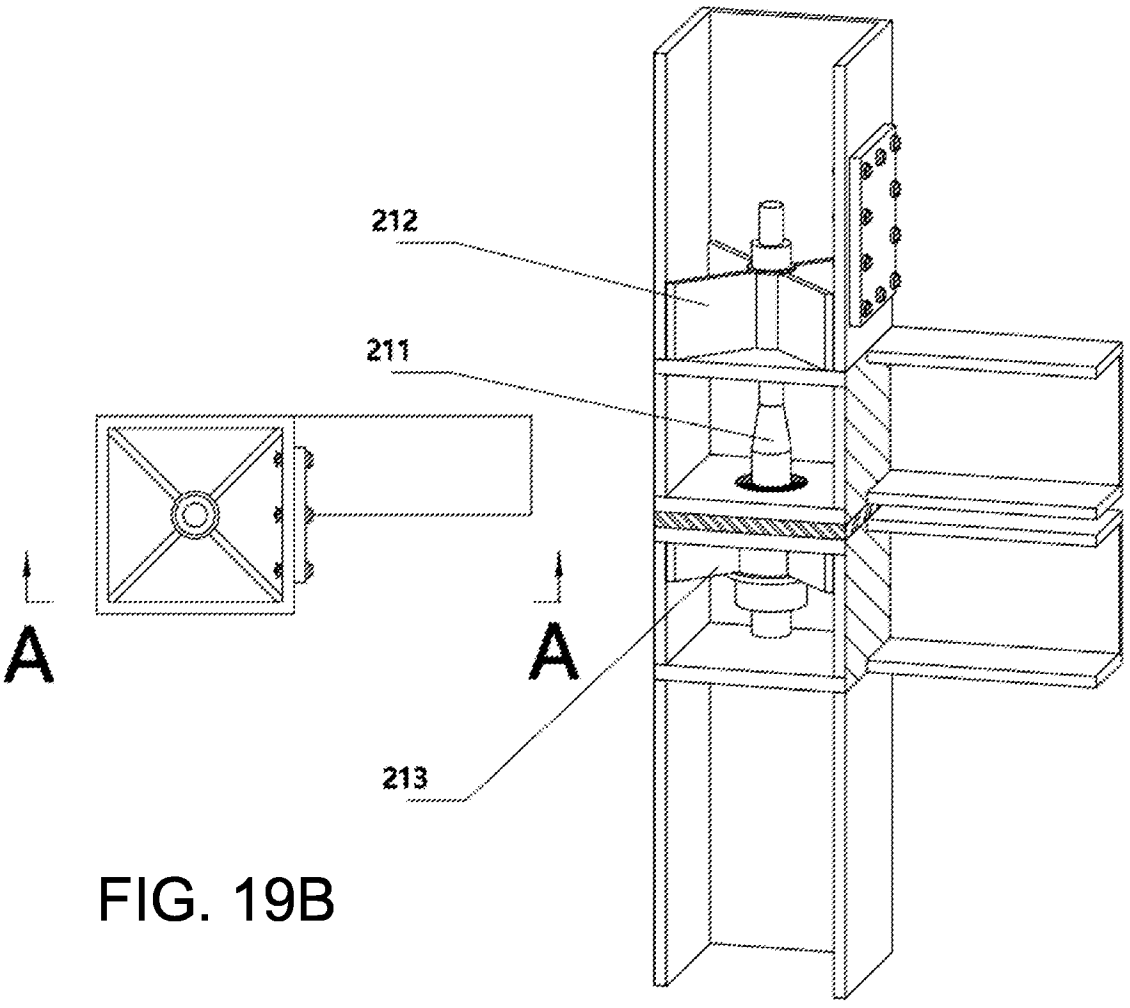
FIG. 19C
FIG. 19B
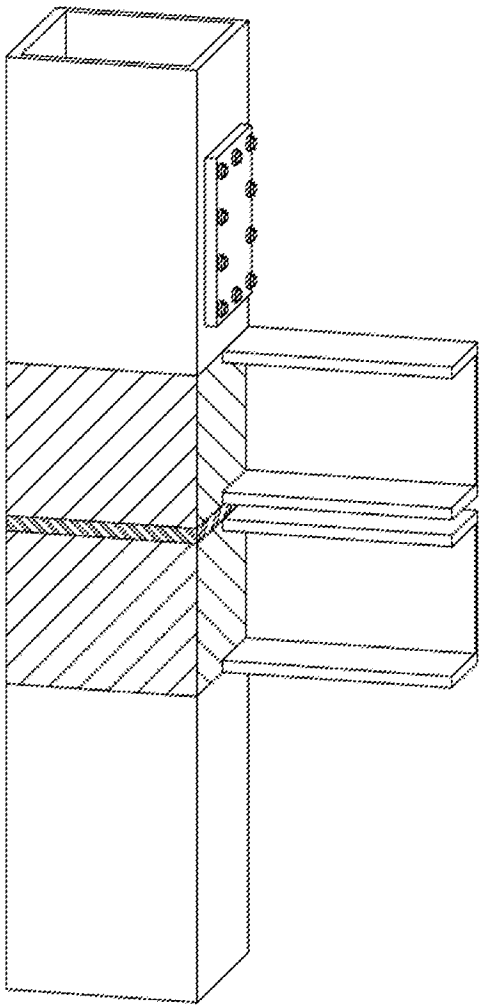
FIG. 19A

EARTHQUAKE-RESISTANT AND SEISMIC-DAMPING MULTIFUNCTION COOPERATIVE SYSTEM FOR MODULAR STEEL STRUCTURE BUILDING

CROSS-REFERENCE TO RELATED APPLICATION

This application is a 371 of international application of PCT application serial no. PCT/CN2023/082360, filed on Mar. 17, 2023, which claims the priority benefit of China application no. 202211466272.1, filed on Nov. 22, 2022. The entirety of each of the above mentioned patent applications is hereby incorporated by reference herein and made a part of this specification.

TECHNICAL FIELD

The present invention relates to the field of earthquake resistance of building structures, and in particular to an earthquake-resistant and seismic-damping multifunction cooperative system for a modular steel structure building.

TECHNICAL BACKGROUND

Industrialization of construction is an inevitable trend in the development of China's construction industry. Modular buildings, as the most industrialized building type at present, meet the development requirements of China's construction industry and represents the development direction of China's construction industry. Due their characteristic of faster construction, the modular buildings meet the current demand of high turnover in the industry, and are gradually gaining attention and ushering in development.

Compared with concrete, steel is a green building material that is recyclable in full life cycle. The combination of steel structures and modular buildings is in line with the modern development direction of green and industrialized construction industry. A modular steel structure building is a green building in full life cycle, which fits perfectly with China's realities of increasingly higher requirements for environmental friendliness and decreasing labor force year by year, and has become the up-to-date frontier development trend of modular buildings and an inevitability of future development.

The modular steel structure building shown in FIG. 1 includes a plurality of building modules (as shown in FIG. 2). Since individual building modules have separate floor and ceiling boards, a unique double-beam double-board structure (as shown in FIG. 3) is formed at the beam-column joint of the modular steel structure building. The double-beam double-board structure can significantly reduce the load level of the ceiling board, which is conducive to the lightweight design of the ceiling beams and the effective use of space inside the building module. Although this design makes good use of the structural characteristics of the modular buildings, it significantly reduces the load bearing capacity of ceiling beams, making them relatively weak members in the modular buildings.

Currently, vertical and horizontal connections between adjacent building modules are realized through a joint as shown in FIG. 4, and a schematic mechanical view of this joint is shown in FIG. 5. The working principle of the above traditional joint is as follows: adjacent building modules in the vertical direction are connected through the joint shown in the figure to form a vertical building module structure (as shown in FIG. 6), and horizontal shear force is transferred between adjacent vertical building module structures through a common connecting plate so as to form a modular steel structure (as shown in FIG. 7). However, such design is limited by the construction space and construction accuracy, and the common connecting plate only provides horizontal constraints for adjacent vertical building module structures.

China is one of the most earthquake-prone countries in the world, and more than half of the areas are located in high-intensity zones of seismic intensity 7 and above, posing a serious threat to the lives and property of people in China. Past earthquakes have shown that the damage and collapse of building structures are the root cause of casualties and economic losses, so how to mitigate civil engineering disasters caused by earthquakes has become a core issue in the field of earthquake engineering in China. Existing research shows that modular steel structures suffer from a series of key problems such as insufficient integrity and abrupt changes in connection stiffness, which are highlighted by the fact that there are only horizontal constraints provided by the common connecting plate without necessary vertical restraints between the adjacent vertical building module structures. Due to the lack of the vertical restraints, when the modular steel structure undergoes an earthquake, each vertical building module structure works independently, and the connection joint between building modules will have a vertical deformation difference (as shown in FIG. 8). The above problems pose a great risk to the seismic safety of modular steel structure buildings, which hinders the large-scale application of such novel buildings in China.

The use of seismic damping and isolation technology is one of the important means to improve the seismic performance of building structures. In September 2021, the State Council of China promulgated the Regulations on the Anti-seismic Management of Construction Projects, which clearly states that seismic damping and isolation technology is given priority to improve the seismic performance of building structures. Actual projects show that although the seismic isolation technology can reduce the energy input to the structure by earthquake, it is not economical enough. Moreover, compared with the traditional steel structure, the modular steel structure has higher construction cost. If the seismic isolation technology is applied to the modular steel structure, its application cost will be further pushed up, which is not in line with the relevant requirement of the industry in terms of economy.

Based on the above, an effective combination of the seismic damping technology with lower cost with modular steel structure buildings is a practical way to improve the seismic performance of such novel prefabricated buildings at this stage. The existing seismic damping technology is proposed based on the deformation characteristics of traditional building structures, and shows good adaptability in the construction process of traditional building structures in the past. However, the modular steel structure buildings are obviously different from traditional buildings in terms of structural characteristics, sequence of construction and functionality. Therefore, the application of the existing seismic damping technology to modular steel structure buildings will face the following problems:

(1) It is Difficult to Effectively Combine the Existing Seismic Damping Technology with the Modular Steel Structure Buildings:

As described above, the existing seismic damping technology is applied to traditional buildings. In view of the deformation characteristics of the traditional buildings undergoing an earthquake, according to the existing seismic damping technology, dampers are concentratedly arranged between stories and between beams, and the specific arrangement types mainly include brace type, buttress type and haunch brace type (as shown in FIG. 9A-9C). In such arrangements, the dampers can use the inter-story displacement of the traditional structure undergoing the earthquake as an effective excitation to enter an energy dissipating working state. It should be noted that the dampers generate considerable additional internal force in the energy dissipating working state. In traditional structures, this additional internal force can be beared and transferred through beams and columns. Compared with the traditional structures, the modular steel structure buildings are obviously different in terms of sequence of construction, functionality and structural characteristics. The ceiling beams of the modular steel structures are mostly designed to be lightweight, and thus have low load bearing capacity, so it is difficult for them to bear the additional internal force brought by the existing seismic damping technology. If the existing seismic damping technology is applied to the modular steel structures, it will bring unnecessary additional load to the ceiling beams, which will inevitably lead to an increase in the cross section of the ceiling beam, making the modular steel structures no longer in line with the structural characteristics of such novel buildings. In addition, due to transportation conditions, there may be practical problems such as limited clear height and limited available space between floors of the modular buildings, so it is a realistic demand for such buildings to ensure their functionality. However, the implementation of the existing seismic damping technology will inevitably lead to the occupation of the space under the beam (as shown in FIG. 9A-9C), which will further reduce the available space of the building and further affect the functionality of the building.

(2) There is Lack of Good Integrity and Multiple Seismic Fortification Lines Between Multiple Module Structures in the Horizontal Direction:

As described above, there are only horizontal constraints between adjacent module columns in the horizontal direction, and there is lack of effective vertical constraints between adjacent vertical building module structures, so there is lack of good integrity between multiple module structures in the horizontal direction. When the modular steel structure building undergoes an earthquake, the vertical building module structures bear forces separately, there are a pair of vertical opposite shear forces at the vertical beam-column joint (as shown in FIG. 8). This pair of shear forces respectively act on adjacent module columns and accumulate in the height direction of the building. When the modular building undergoes a major earthquake, it is easy to lead to an excessive axial-compression ratio of the module column on one side, causing damage to the module column due to loss of stability and thus increasing the risk of collapse of the modular building.

Further, since there is lack of good integrity in the existing modular structure, when the modular structure undergoes an earthquake, only the multiple module structures in the vertical direction work independently, and the adjacent building modules in the horizontal direction only transfer horizontal shear forces therebetween, but do not bear forces as a whole. This makes the modular steel structure lack of space for arranging the multiple seismic fortification lines under the existing anti-seismic conditions, thereby affecting the seismic safety of such buildings and limiting the application range of such buildings.

To sum up, it is difficult for the existing seismic damping technology to be applied to the modular steel structure mainly due to problems such as, poor adaptability of the existing seismic damping technology, lack of space for arranging multiple seismic fortification lines and so on.

SUMMARY OF THE INVENTION

In order to solve the problems in the prior art, the present invention provides an earthquake-resistant and seismic-damping multifunction cooperative system for a modular steel structure building, which significantly improves the integrity of the modular steel structure and effectively combines the modular steel structure building with a seismic damping technology. Moreover, by arranging multiple fortification lines, seismic performance of the modular steel structure is improved. The schematic mechanical view of the system is shown in FIG. 10. The system mainly includes: a building-integrated module and connection joints between building modules. The building module mainly includes: ceiling beams, local high-strength module columns and local high-strength module bottom beams. The connection joints between building modules mainly include: vertical building module connection joints, hinge joints between horizontal building modules and frictional connections between horizontal building modules. In this structural system, main energy dissipating and seismic damping members are ceiling beam rotational friction joints and frictional connections between horizontal building modules. The building modules are connected efficiently and reliably through the vertical building module connection joints to form a vertical building module structure. Horizontal shear force between building modules is transferred between the adjacent vertical building module structures through the hinge joint between horizontal building modules. Further, the frictional connections between horizontal adjacent building modules provide vertical constraints between the vertical building module structure to further improve the integrity of a cluster of columns in the system, so that the cluster of columns can bear forces together under certain conditions and can also produce sliding friction under certain conditions to realize energy dissipation and seismic damping.

With such design, the structural system can realize three seismic fortification lines, namely an earthquake resisting working state, a first seismic damping working state and a second seismic damping working state. When the modular steel structure undergoes a minor earthquake, the structure enters an earthquake resisting working state (as shown in FIG. 11). In this case, none of the main energy dissipating and seismic damping members enters an energy dissipating working state, and the main structure remains elastic and maintains the basic functionality of the building. When the structure undergoes a moderate earthquake, the structure first enters the first seismic damping working state, and the ceiling beam rotational friction joints enter a rotational energy dissipating working state, so that the lateral stiffness of the structure is decreased preliminarily and the energy input of the earthquake is reduced preliminarily, and the deformation of the structure is shown in FIG. 12. When the structure undergoes a major earthquake, the structure enters the second seismic damping working state. In this case, the frictional connections between horizontal building modules enter the energy dissipating working state, and the deformation of the structure is as shown in FIG. 13. The lateral stiffness of the structure is further decreased, and the energy input of the earthquake is further reduced. Thus, by effectively combining the seismic damping technology with the modular steel structure, the integrity of the modular steel structure building is significantly improved, so that a module system in which multiple modules bear forces cooperatively is formed, which both improves the structural integrity and realizes the arrangement of multiple seismic fortification lines for the modular steel structure building.

In order to realize the above functions, the present invention provides an earthquake-resistant and seismic-damping multifunction cooperative system for a modular steel structure building, mainly including a building-integrated module and connection joints between building modules. As shown in FIG. 14, the earthquake-resistant and seismic-damping multifunction cooperative system for a modular steel structure building provided by the present invention includes a building-integrated module and connection joints between building modules. The building-integrated module includes a plurality of building modules. Each building module includes ceiling beams, local high-strength module columns and local high-strength module bottom beams. The ceiling beam includes a middle beam section and cantilever beam sections located on two sides of the middle beam section. Each cantilever beam section is connected to the middle beam section through a ceiling beam rotational friction joint. The connection joints between building modules include vertical building module connection joints, hinge joints between horizontal building modules and frictional connections between horizontal building modules. Adjacent building modules in a vertical direction are connected through the vertical building module connection joint. Adjacent building modules in a horizontal direction are hinged through the hinge joint between horizontal building modules to realize transfer of module horizontal shear forces between building modules and also connected through the frictional connection between horizontal building modules to provide vertical constraints, and the frictional connection between horizontal building modules is capable of moving axially relative to the local high-strength module column.

The ceiling beam is designed with three sections, including two cantilever beam sections and a middle beam section, which are connected by two rotational friction joints. The module columns and the module bottom beam are also each designed with three sections, and local high-strength steel sections (dashed areas in the figure) are arranged at two ends of each of the aforementioned members, thereby ensuring the members to keep elastic when the structure bears an earthquake load.

As described above, the main energy dissipating and seismic damping members in the building-integrated module are ceiling beam rotational friction joints. The energy dissipating and seismic damping function of the rotational friction joints is realized in a way as follows: As shown in FIG. 15A-15B, when the structure bears an earthquake load, as the structure is in the earthquake resisting working state, the ceiling beam rotational friction joints do not rotate, and the ceiling beams keep elastic. When the structure enters the seismic damping working state, the ceiling beam rotational friction joints rotate and transfer part of bending moment and shear forces, and dissipate energy by means of rotation, thereby realizing energy dissipation and seismic damping.

In order to realize the above functions, the ceiling beam rotational friction joint dissipates energy by means of friction, as shown in FIG. 16A-16B, which mainly includes: a beam connecting plate, on-beam high/low friction surfaces, a beam connecting plate pad, a sliding pad, a pin and one-sided bolts. The cantilever beam section is rigidly connected with the module column, and the beam connecting plate connects a web of the middle beam section with a web of the cantilever beam section. The cantilever beam section and the beam connecting plate are provided with circular holes at corresponding positions and connected through the one-sided bolts, and the beam connecting plate pad is sandwiched between the beam connecting plate and the cantilever beam section. The beam connecting plate and the middle beam section are connected through the pin. The middle beam section is rotatable around the pin. The on-beam high friction surface is sandwiched between the beam connecting plate and the middle beam section. The sliding pad is arranged on the beam connecting plate, and the on-beam low friction surface is sandwiched between the sliding pad and the beam connecting plate. The one-sided bolt is used to sequentially connect the sliding pad, the low friction surface, the beam connecting plate, the high friction surface and the web of the middle beam section and apply a pretension force. It should be noted that the beam connecting plate is provided with an arc-shaped slotted hole at a corresponding position, and the other plates are provided with circular holes. With such design, at the friction joint, the shear force of the ceiling beam is transferred by the pin, and the bending moment is controlled by friction force between the beam connecting plate and the web of the corresponding middle beam section. When the structure is in the earthquake resisting working state, the bending moment at the joint cannot overcome the friction force, and the joint does not rotate. When the structure enters the seismic damping working state, the joint rotates as shown in FIG. 17A-17B under the action of the bending moment, and the energy dissipating and seismic damping function is realized by means of the sliding friction between the high friction surface and the beam connecting plate, thereby realizing the set function of the ceiling beam rotational friction joint.

The connection joints between building modules mainly include: vertical building module connection joints, hinge joints between horizontal building modules and frictional connection between horizontal building modules. The vertical building module connection joints and the hinge joints between horizontal building modules can be realized by means of the existing related structures, including, but not limited to, tie rod shear lock connection joints shown in FIGS. 19A-19C and FIGS. 20A-20B. According to the vertical building module connection joint shown in FIGS. 19A-19C, upper and lower building modules are connected through the tie rod shear lock, and a connecting plate is sandwiched between the upper and lower building modules. As shown in FIG. 20A-20B, a common connecting plate is arranged to connect the adjacent building modules in the horizontal direction, thereby realizing the hinge joint between horizontal building modules.

As described above, the main energy dissipating and seismic damping members between the modules are frictional connections between horizontal building modules, and the working principle is as shown in FIG. 20A-20B. The main functions of the frictional connection are as follows: The main functions of the frictional connection are as follows: When the structure bears an earthquake load, the adjacent building modules in the horizontal direction do not slide relatively in the vertical direction when the structure is in the earthquake resisting working state and the first seismic damping working state, and the adjacent module columns may be regarded as a cluster of columns to bear forces together. As the structure enters the second seismic damping working state, the adjacent columns slide relatively in the vertical direction and realize energy dissipation and seismic damping by means of sliding friction.

As shown in FIG. 21A-21C, the frictional connection specifically includes a pad between adjacent module columns, an in-column bolt pad, high/low friction surfaces and one-sided bolts. The adjacent two module columns are respectively provided with a circular hole and a vertical slotted hole at corresponding positions. The pad between columns is sandwiched between the two columns and rigidly connected to the module column provided with the circular hole. The high friction surface is sandwiched between the pad between columns and the module column provided with the slotted hole. An in-column pad is arranged in the module column provided with the slotted hole and is immediately adjacent to the slotted hole, and the low friction surface is arranged between the pad and an inner wall of the module column. The one-sided bolt sequentially passes through the in-column pad, the low friction surface, a web of the module column provided with the slotted hole, the high friction surface, the pad between columns and a web of the module column provided with the circular hole and applies a pretension force. It should be noted that only the web of the module column on one side is provided with the slotted hole, and the other plates are provided with circular holes. With such arrangement, an axial relative movement may occur between the adjacent module columns in the horizontal direction, and this axial relative movement is controlled by friction force between the high friction surface and the web of the module column provided with the slotted hole. When the structure bears a lower load, the shear force at this connection cannot overcome the friction force, and the adjacent building columns do not move relatively with each other and can be regarded as an integral cluster of columns. When the structure bears a higher load, the shear force at the connection increases, and the adjacent columns slide relatively with each other. Due to the presence of the friction force, this connection can transfer part of axial force in the module column and can also dissipate energy by means of friction, thereby realizing the set function of the frictional connection between horizontal building modules.

Compared with the Prior Art, the Present Invention at Least has the Following Beneficial Effects:

The earthquake-resistant and seismic-damping multifunction cooperative system for a modular steel structure building provided by the present invention solves a series of key problems such as incompatibility of the existing seismic damping technology with such buildings, insufficient integrity of modular buildings and lack of design of multiple seismic fortification lines when designing such buildings for earthquake resistance and disaster prevention.

(1) The Seismic Damping Technology is Effectively Combined with the Modular Steel Structure.

According to the earthquake-resistant and seismic-damping multifunction cooperative system provided by the present invention, the dampers are designed based on related structural characteristics and deformation characteristics of the modular steel structure, so that the seismic damping technology is effectively combined with the modular steel structure. Specifically, the seismic damping technology is integrated into the beam-column joints of the ceiling beam of the building module, and friction dampers are arranged between adjacent vertical building module structures. On the premise of not affecting the functionality of the building, the related design can reasonably utilize the possible construction and maintenance space, fully consider the load bearing capacity of the related members of the modular steel structure, and make full use of the special deformation mechanism of the modular steel structure under the earthquake action, thereby finally effectively combining the seismic damping technology with the modular steel structure building.

(2) A Cooperative System for a Modular Steel Structure with Good Integrity is Provided.

The earthquake-resistant and seismic-damping multifunction cooperative system provided by the present invention effectively solves the problems of relative independence of vertical building module structures and insufficient structural integrity in the existing modular building. By arranging the frictional connections between the adjacent vertical building module structures, the vertical constraints between the adjacent vertical building module structures are added, so that the adjacent building modules in the horizontal direction can transfer both horizontal shear force and vertical axial force. Thus, the multiple modules of the overall structure bear forces cooperatively under three earthquake resisting-seismic damping working states, thereby finally forming the cooperative system for the modular steel structure.

(3) An Earthquake-Resistant and Seismic-Damping Multifunction Structural System for a Modular Steel Structure Having Multiple Seismic Fortification Lines is Provided.

The earthquake-resistant and seismic-damping multifunction cooperative system provided by the present invention not only realizes the above functions, but also realizes the arrangement of the multiple seismic fortification lines for the modular steel structure. By adjusting the elastic load bearing capacity of the related energy dissipating and seismic damping members at different stages, the related energy dissipating and seismic damping members enter the energy dissipating working state in batches, thereby realizing the reasonable arrangement of the multiple seismic fortification lines. By reasonably utilizing the changes in stiffness of the related energy dissipating and seismic damping members in the elastic state and the energy dissipating working state, the whole structure transforms from the earthquake-resistant system to the seismic damping system, thereby significantly reducing the energy input of the earthquake and effectively protecting the structure. The earthquake-resistant system and the seismic damping system are combined to finally form the earthquake-resistant and seismic-damping multifunction structural system for a modular steel structure having multiple seismic fortification lines.

BRIEF DESCRIPTION OF DRAWINGS

FIG. 9A is brace type, FIG. 9B is buttress type, and FIG. 9C is haunch brace type;

FIG. 15A is a schematic view of a vertical building module framework containing ceiling beam rotational friction joints, and FIG. 15B is a schematic view showing deformation of the vertical building module framework containing ceiling beam rotational friction joints;

FIG. 16A is an exploded structural view, and FIG. 16B is a schematic view of the ceiling beam rotational friction joint assembled;

FIG. 17A is a schematic view showing deformation of the joint under the action of a positive bending moment, and FIG. 17B is a schematic view showing deformation of the joint under the action of a negative bending moment;

FIG. 18A is a schematic force diagram of the earthquake-resistant and seismic-damping multifunction cooperative system for a modular steel structure building under an earthquake action, FIG. 18B is a schematic force diagram of adjacent module column isolates connected through frictional connections between horizontal building modules under an earthquake action, FIG. 18C is a schematic diagram showing deformation of the adjacent module column isolates connected through the frictional connections between horizontal building modules under an earthquake action, and FIG. 18D is a schematic diagram showing deformation of the earthquake-resistant and seismic-damping multifunction cooperative system for a modular steel structure building under an earthquake action;

FIG. 19A-19C shows schematic views of a vertical building module connection joint, where FIG. 19A is a three-dimensional view of the vertical building module connection joint, FIG. 19B is a top view of the vertical building module connection joint, and FIG. 19C is a schematic structural view of FIG. 19B along line A-A;

FIG. 20A is a three-dimensional view of the hinge joint between horizontal building modules, and FIG. 20B is an exploded structural view;

FIG. 21A is a front view of the frictional connection between horizontal building modules, FIG. 21B is a top view of the frictional connection between horizontal building modules, and FIG. 21C is a schematic structural view of FIG. 21B along line A-A.

DETAILED DESCRIPTION OF EMBODIMENTS

In order to make the objects, technical solutions and advantages of the present invention more clear, the present invention will be further described in detail below with reference to the accompanying drawings and embodiments. It should be understood that the specific embodiments described herein are merely illustrative of the present invention and are not intended to limit the present invention.

In the description of the present invention, it should be noted that the orientation or position relationship indicated by the term "central", "upper", "lower", "left", "right", "vertical", "horizontal", "inner", "outer" or the like is the orientation or position relationship based on the drawings. It is only for the convenience of describing the present invention and simplifying the description, rather than indicating or implying that the device or element referred to must have a specific orientation or be constructed and operated in a specific orientation, and therefore cannot be understood as a limitation to the present invention. Besides, unless otherwise explicitly specified and defined, the terms "mounting", "linking" and "connection" shall be understood broadly, and may be, for example, a fixed connection, a detachable connection or integration; or may be a direct connection, an indirect connection through an intermediate medium, or an internal communication between two components. For those of ordinary skill in the art, the specific meaning of the above terms in the present invention can be understood according to specific situations.

FIG. 10 to FIG. 22A-22B show an energy dissipating and seismic damping structural system suitable for a modular steel structure building, including a building-integrated module 1 and connection joints between building modules.

Figure 1:
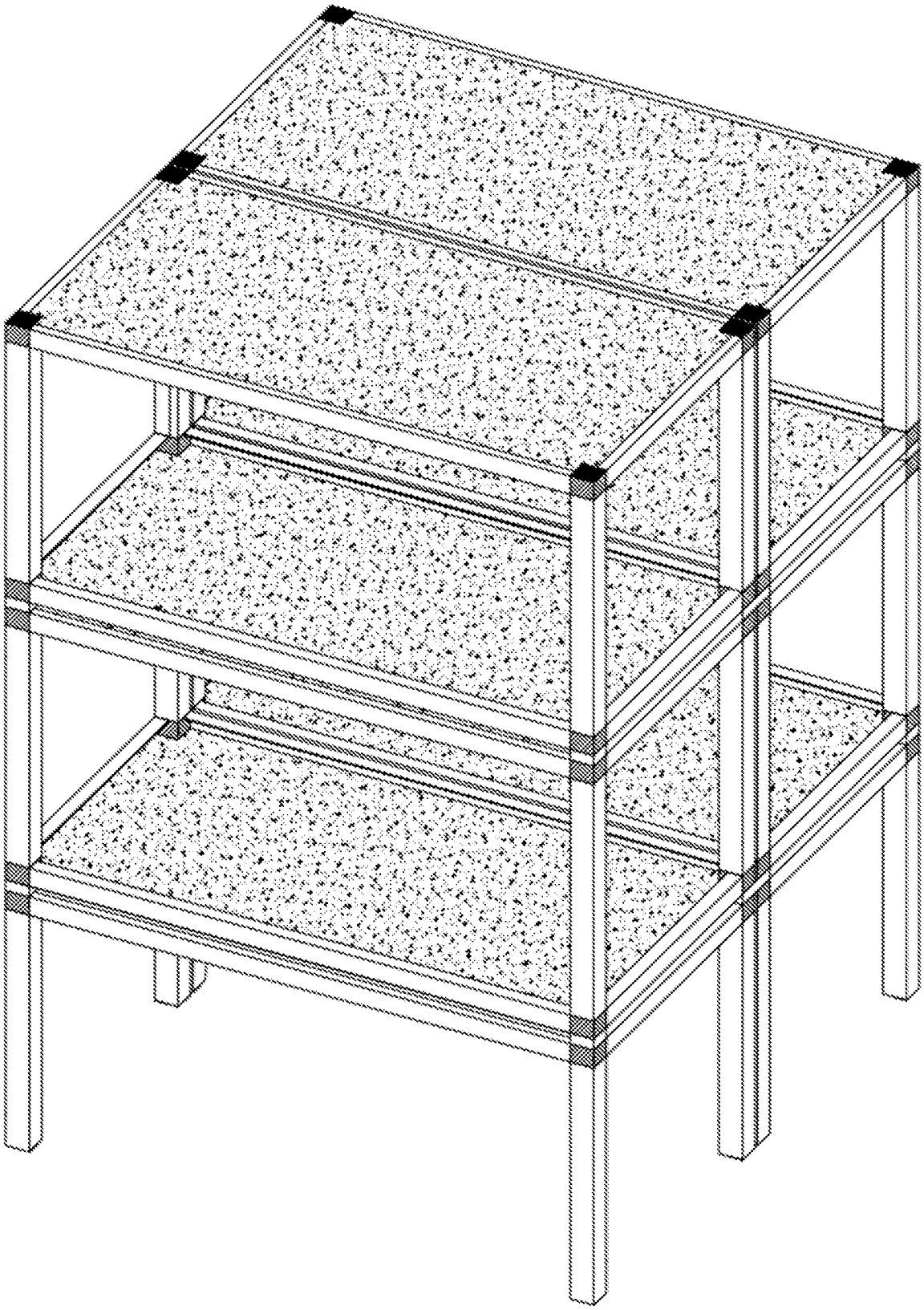
FIG. 1 is a schematic view of an existing modular steel structure building.
Figure 2:
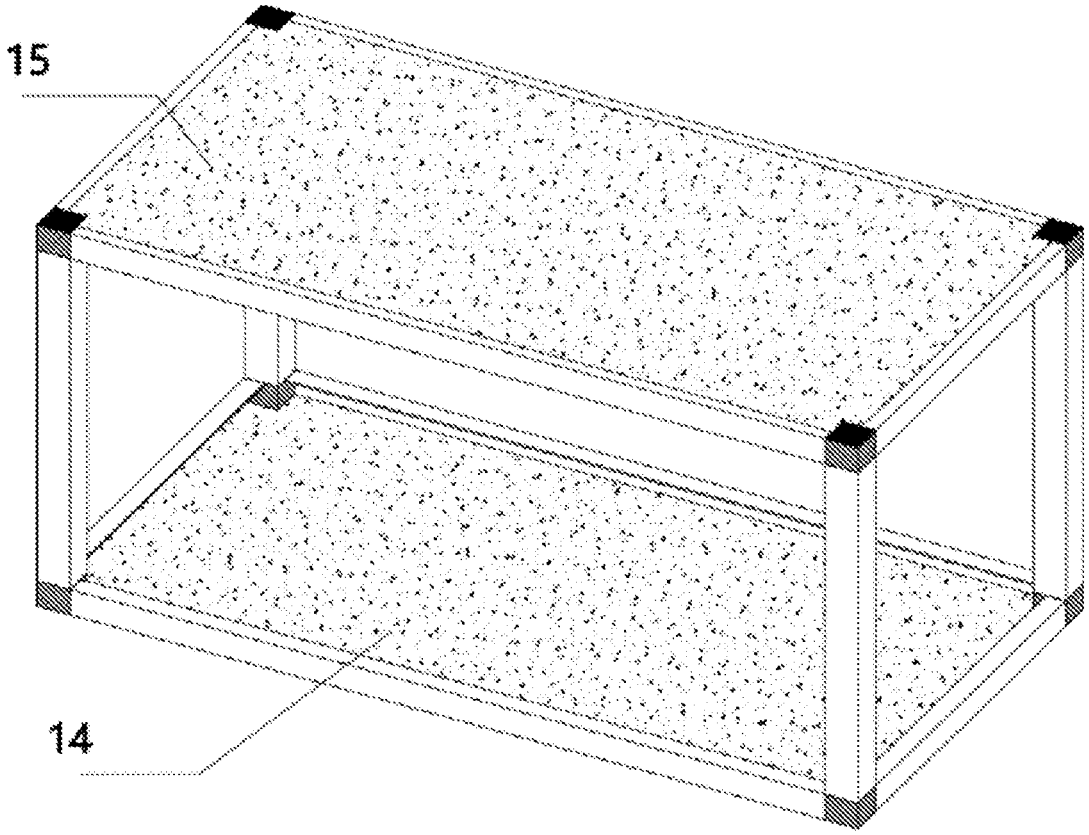
FIG. 2 is a schematic view of an existing building module.
Figure 3:
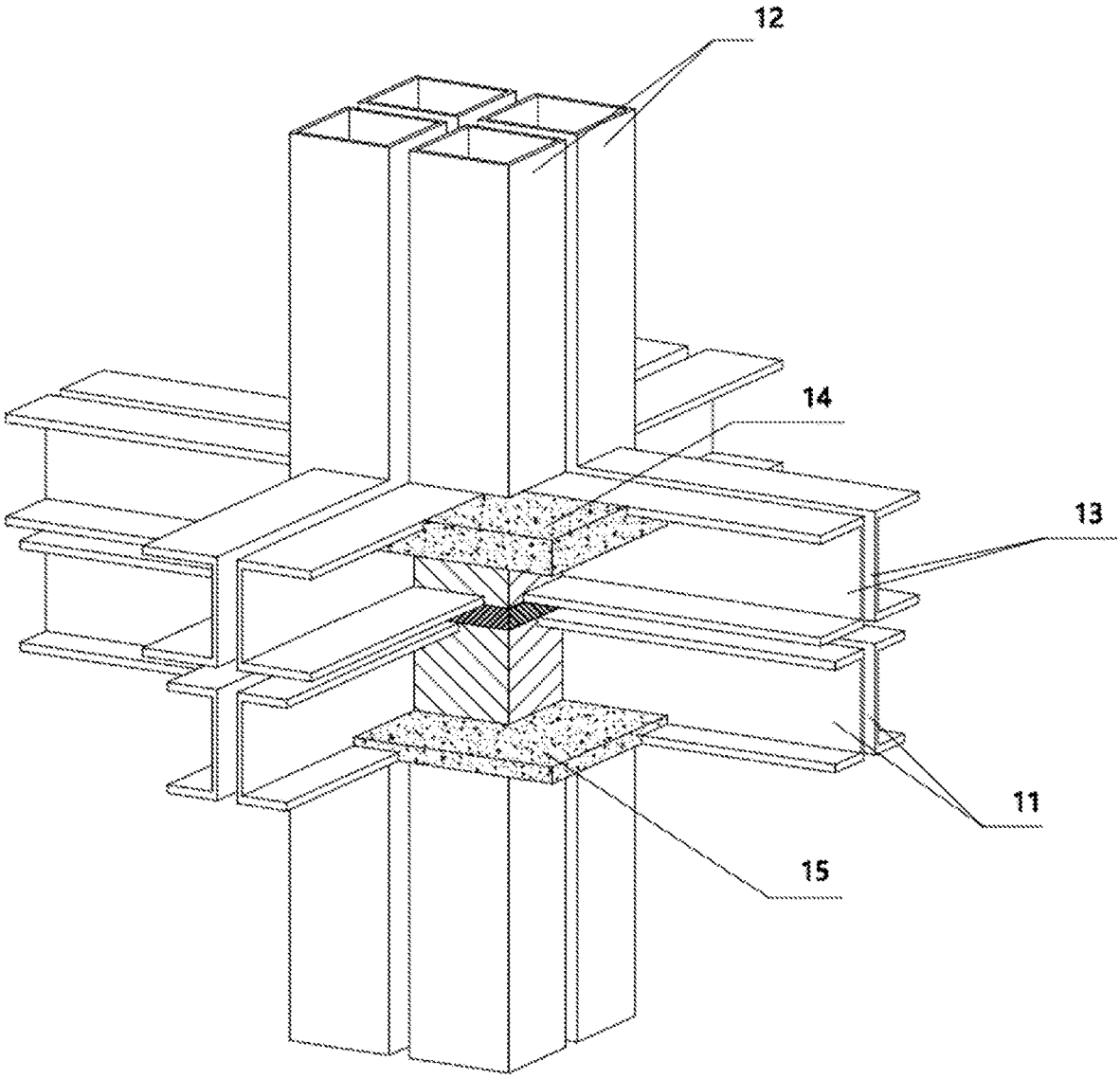
FIG. 3 is a three-dimensional view of an existing traditional connection joint between building modules.
Figure 4:
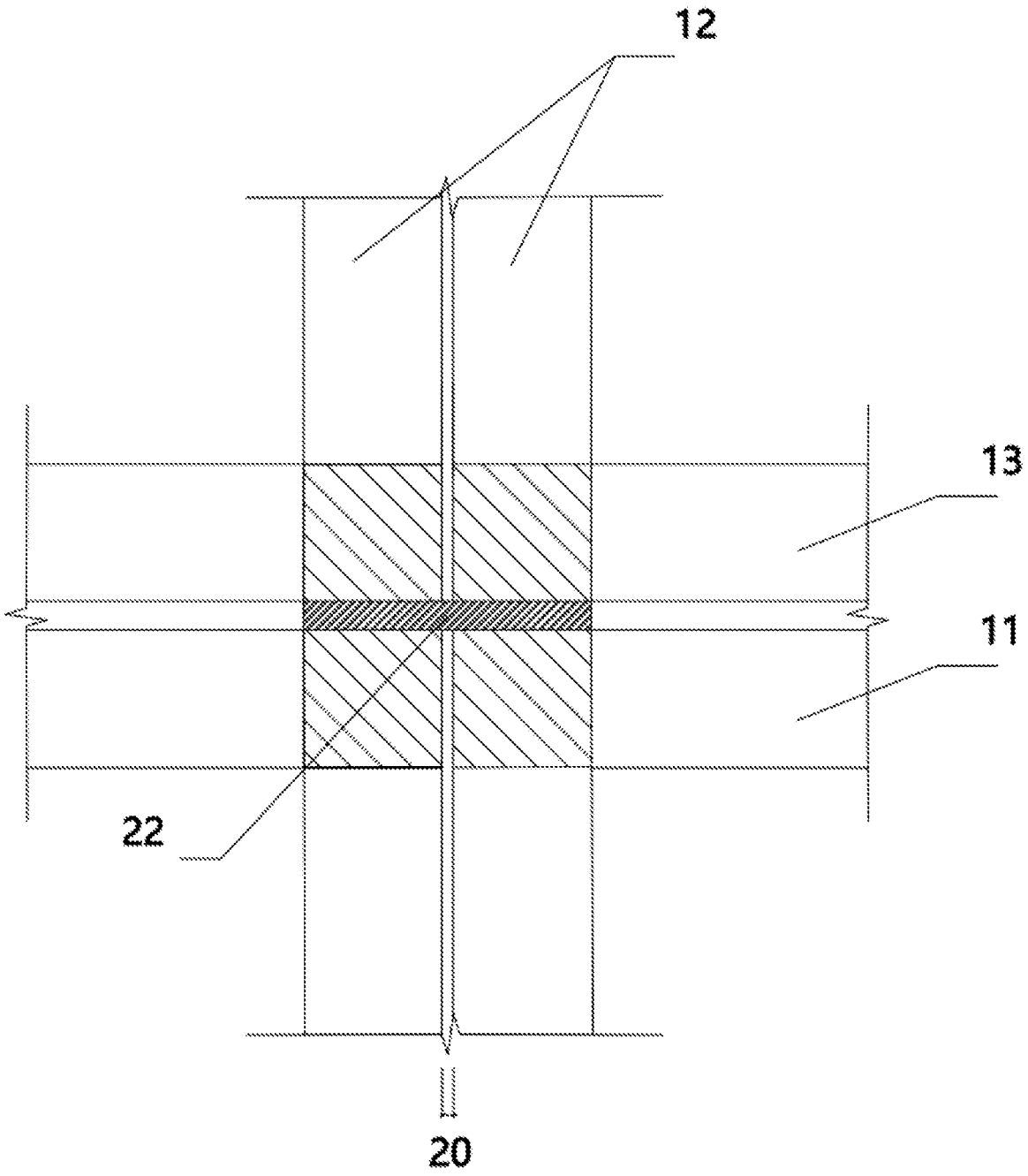
FIG. 4 is a front view of the existing traditional connection joint between building modules.
Figure 5:
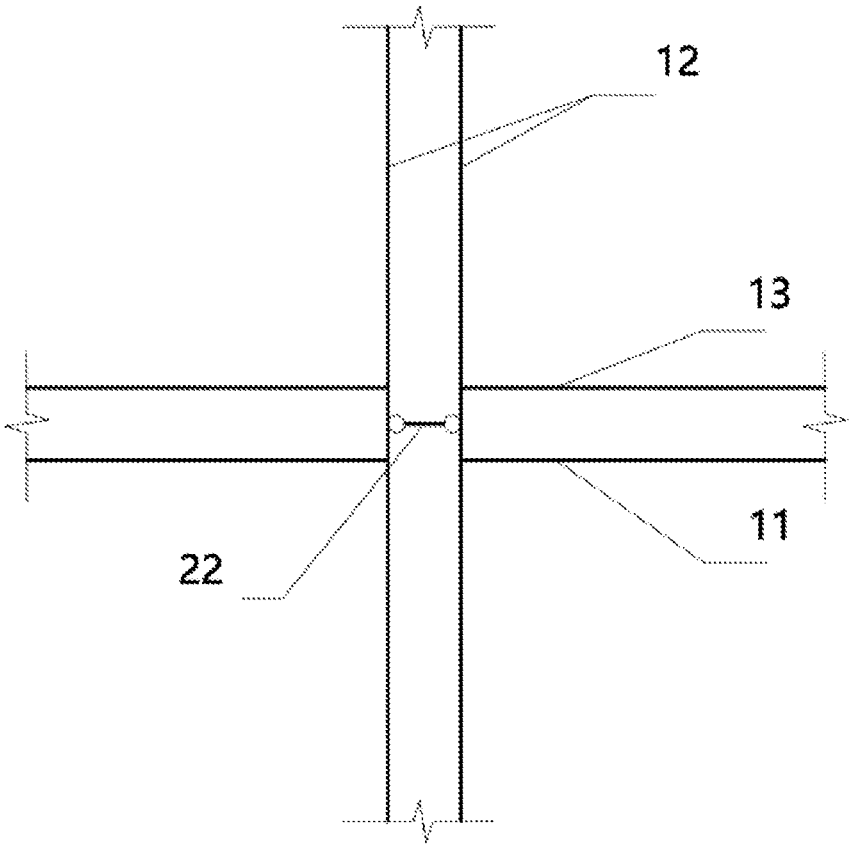
FIG. 5 is a schematic mechanical view of the traditional connection joint.
Figure 6:
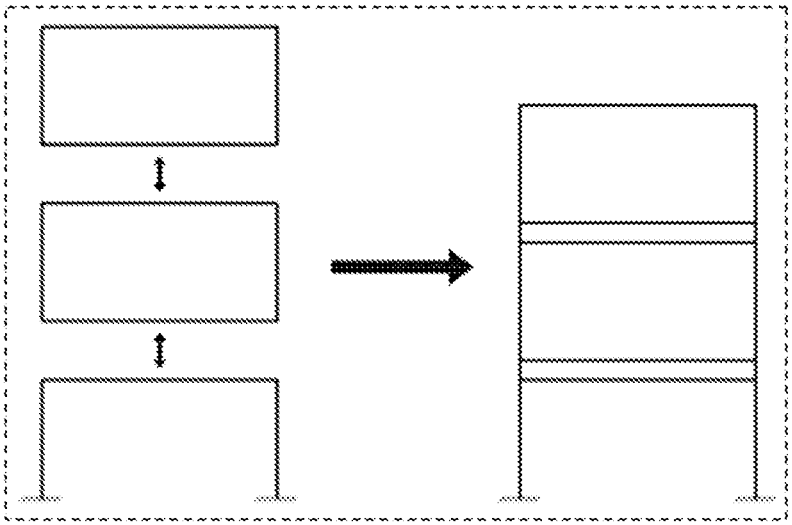
FIG. 6 is a schematic view of an existing vertical building module structure.
Figure 7:
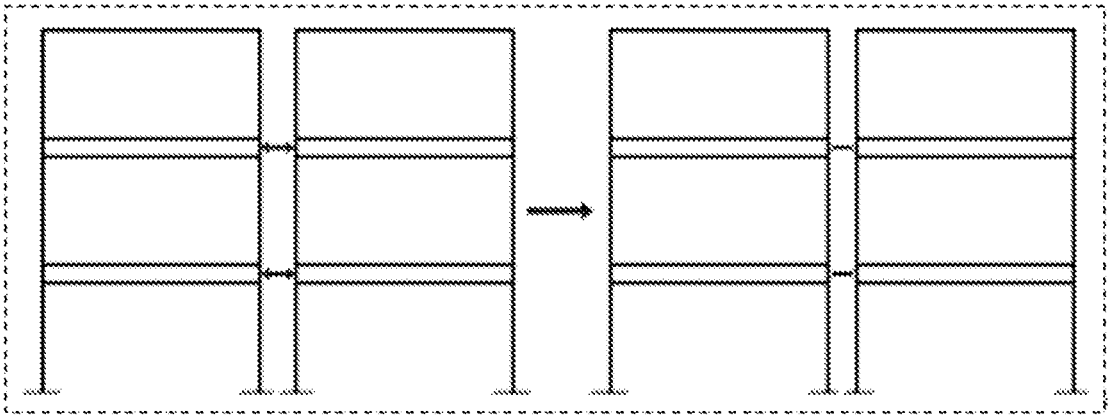
FIG. 7 is a schematic view of an existing modular steel structure.
Figure 8:
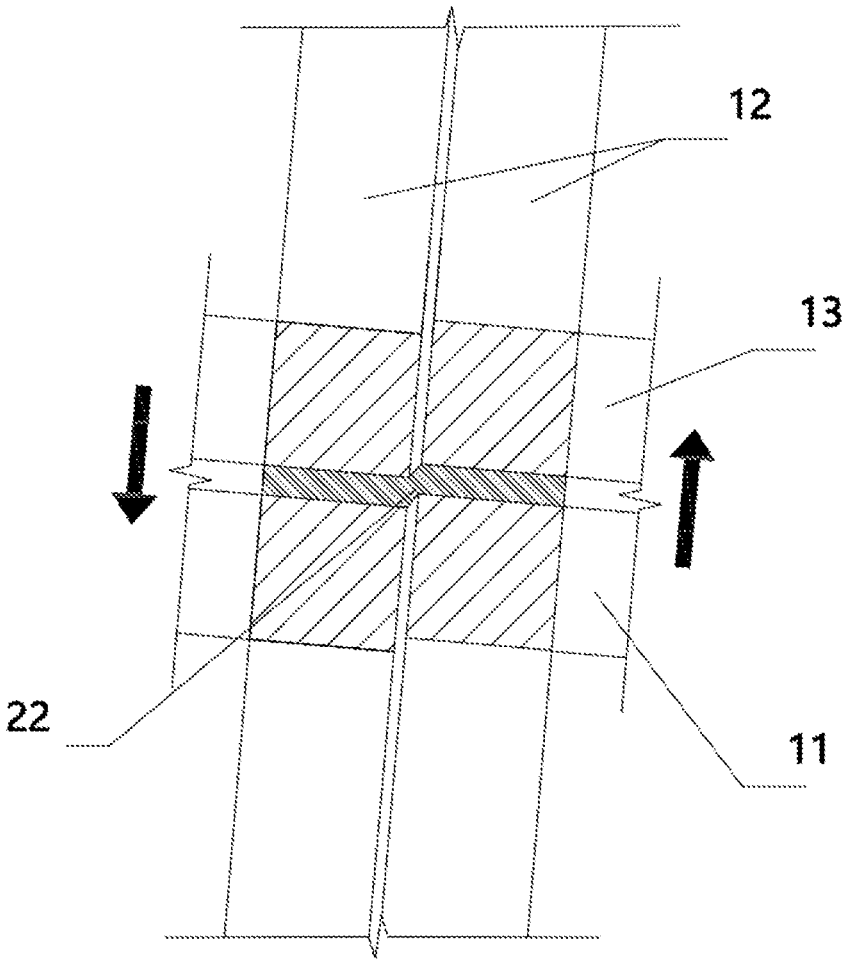
FIG. 8 is a schematic view showing deformation of the existing traditional connection joint between building modules.
Figures 9A, 9B, 9C:
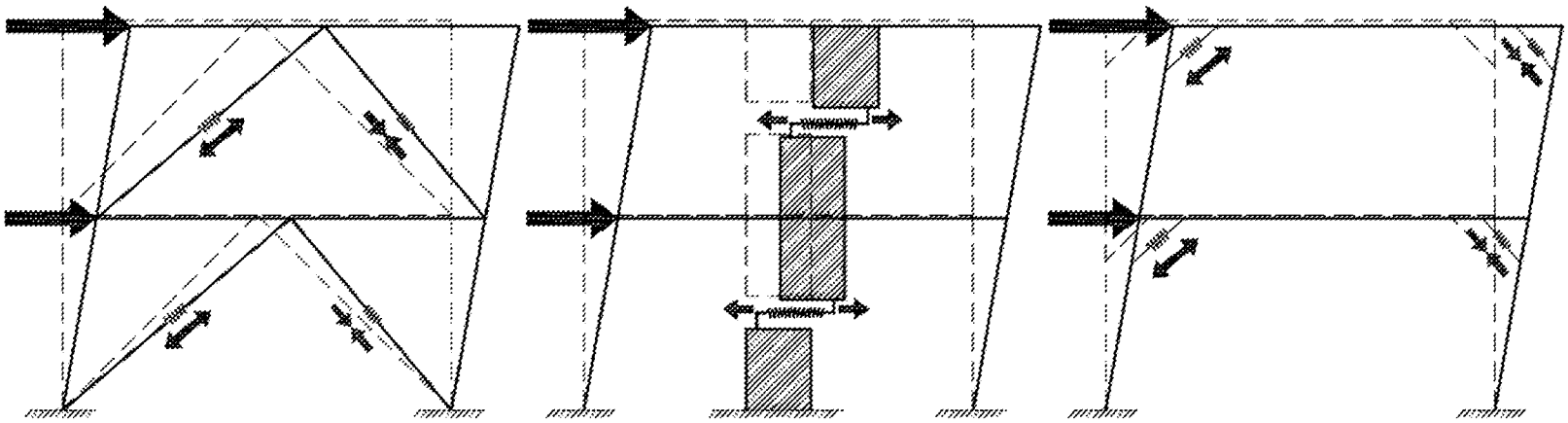
FIG. 9A-9C shows schematic views of main arrangement types of dampers in the existing seismic damping technology, where
Figure 10:
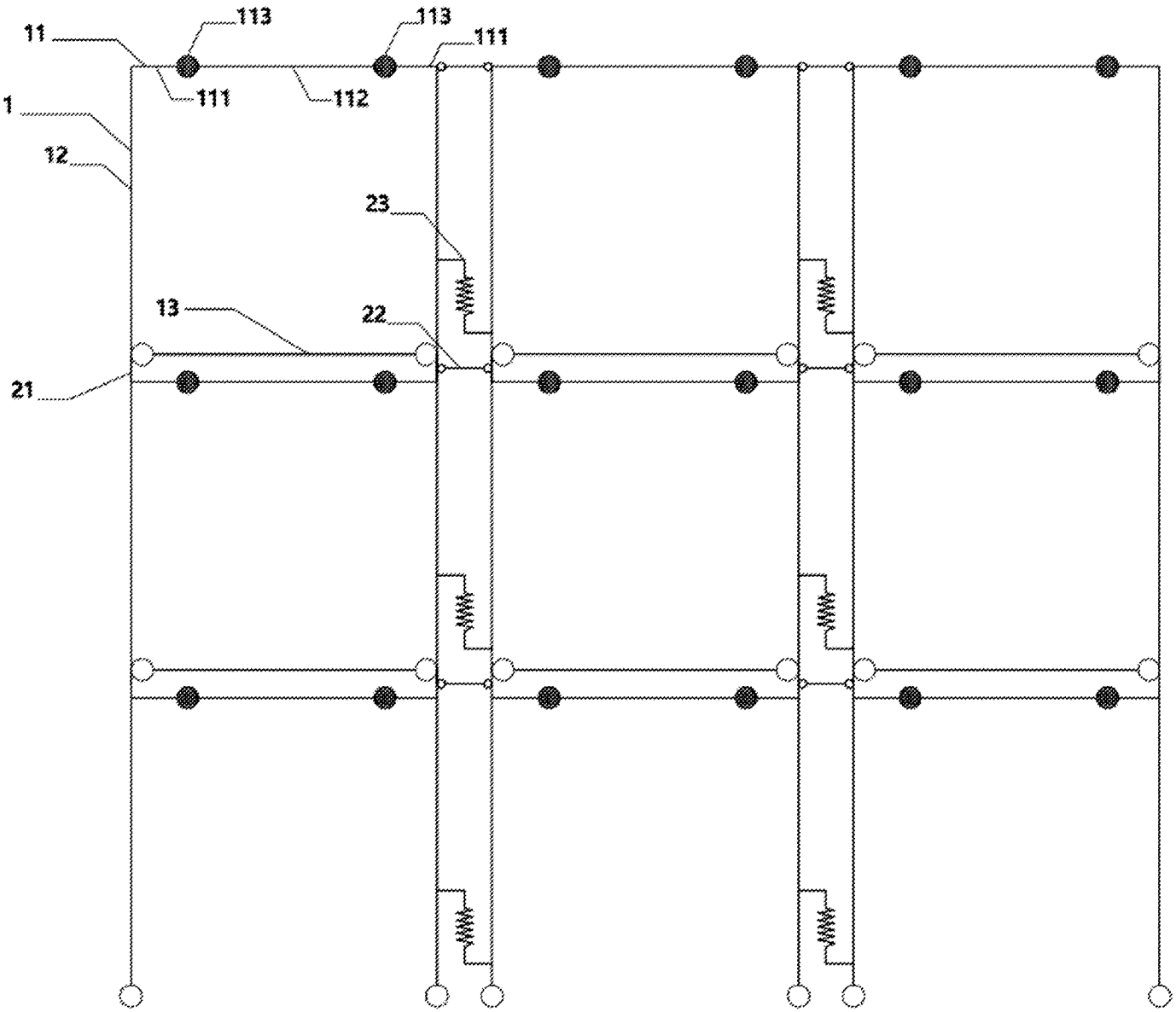
FIG. 10 is a schematic mechanical view of an earthquake-resistant and seismic-damping multifunction cooperative system for a modular steel structure building according to the present invention.
Figure 11:
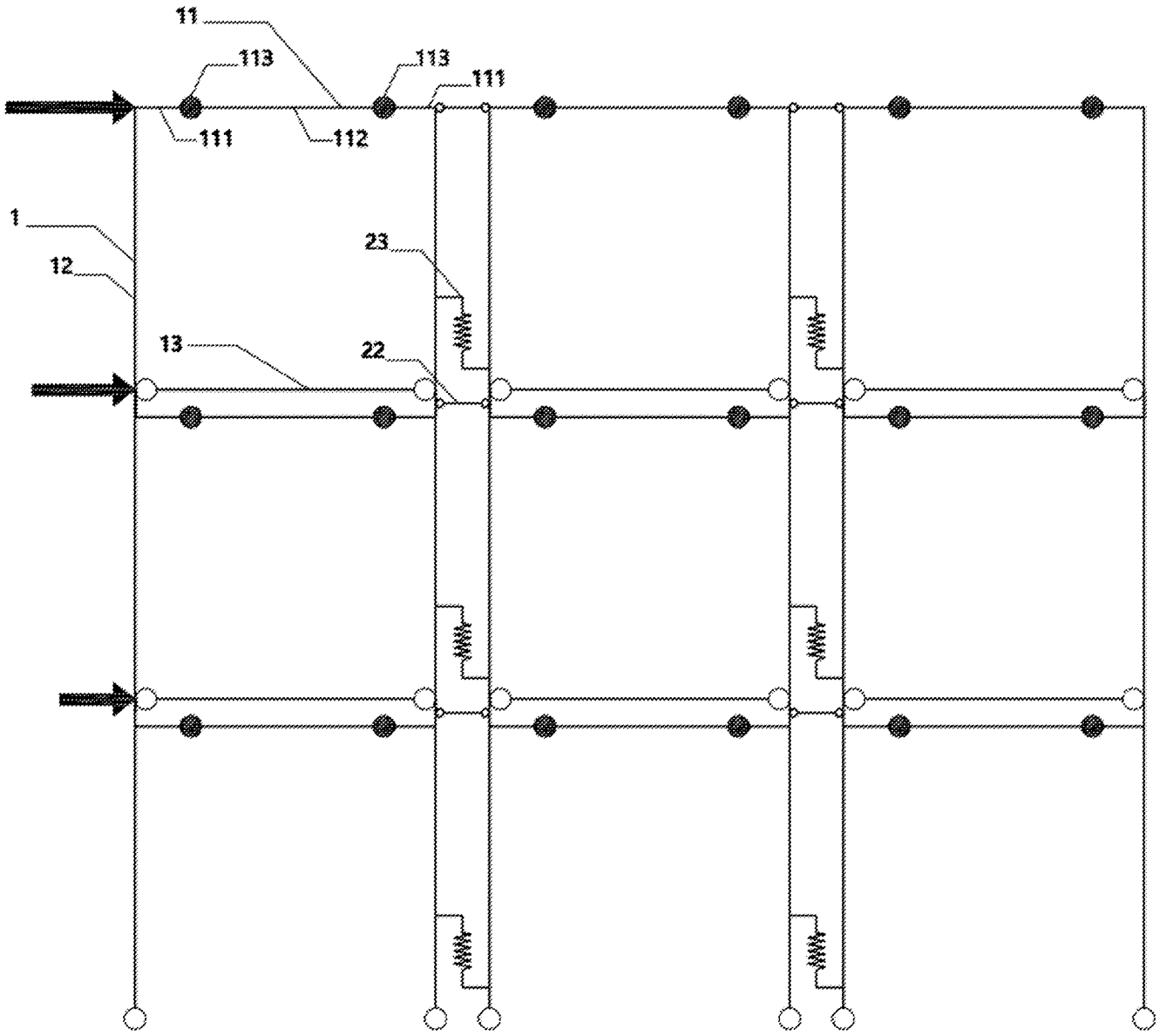
FIG. 11 is a schematic view of an earthquake resisting working state.
Figure 12:
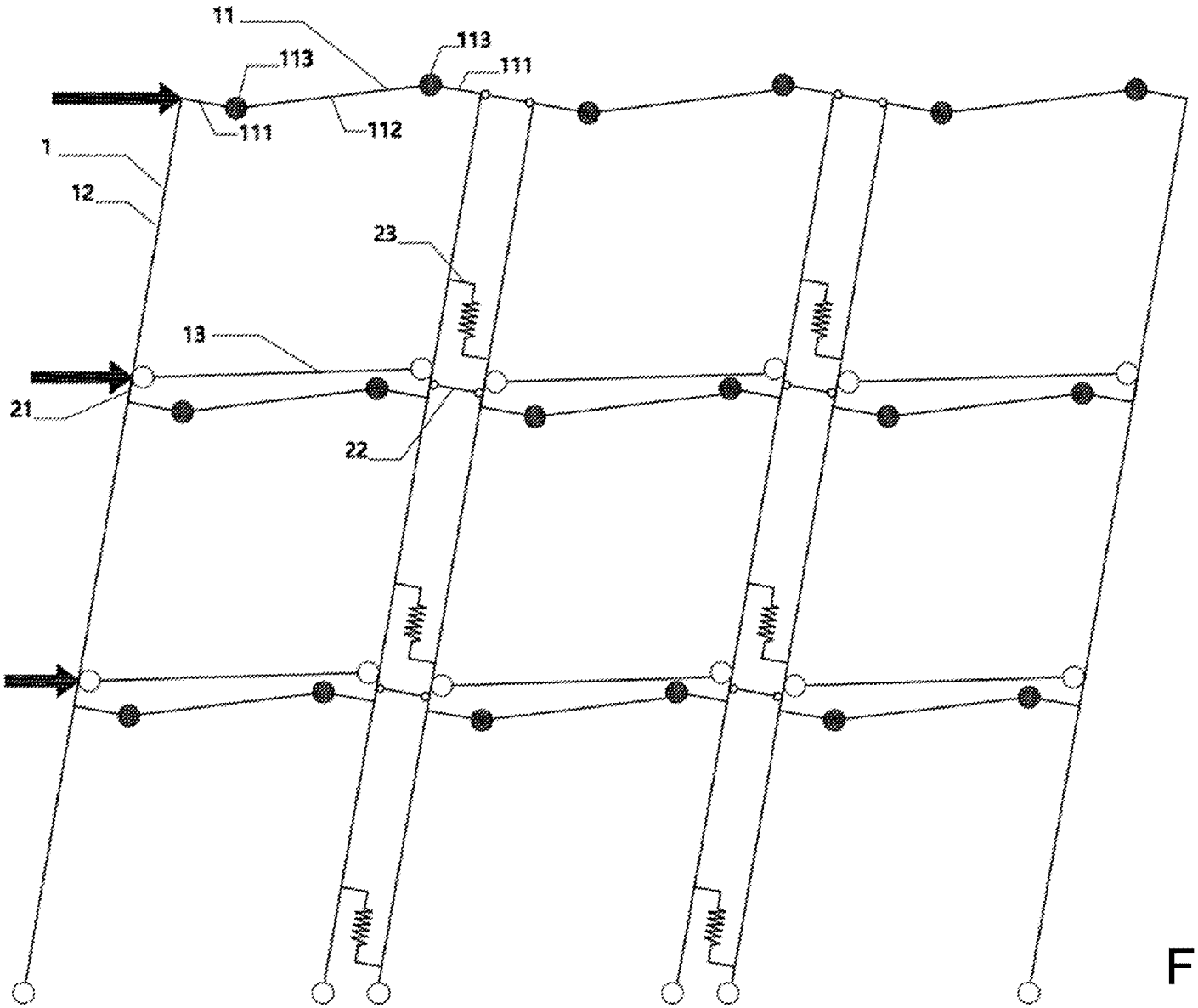
FIG. 12 is a schematic view of a first seismic damping working state.
Figure 13:
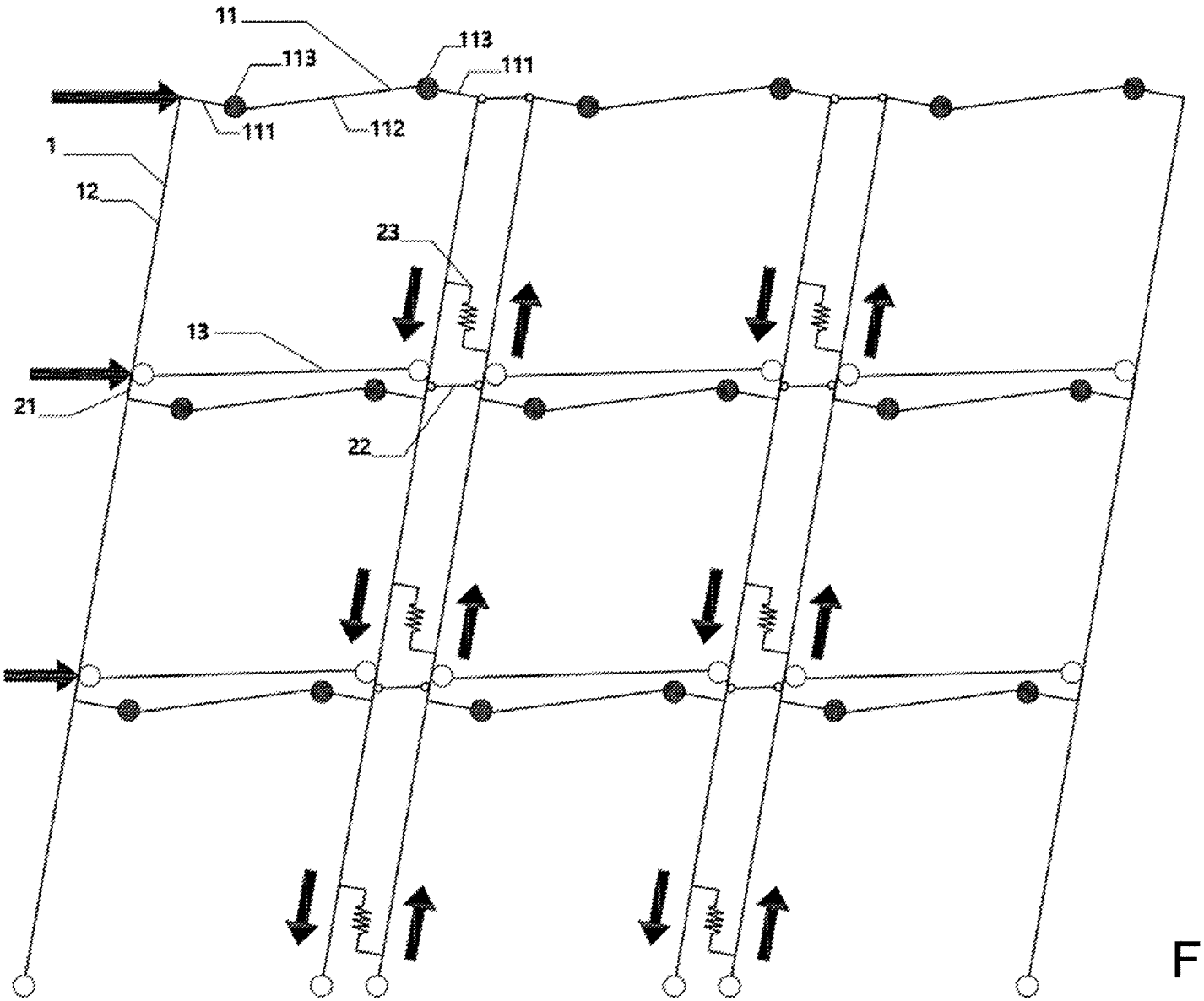
FIG. 13 is a schematic view of a second seismic damping working state.
Figure 14:
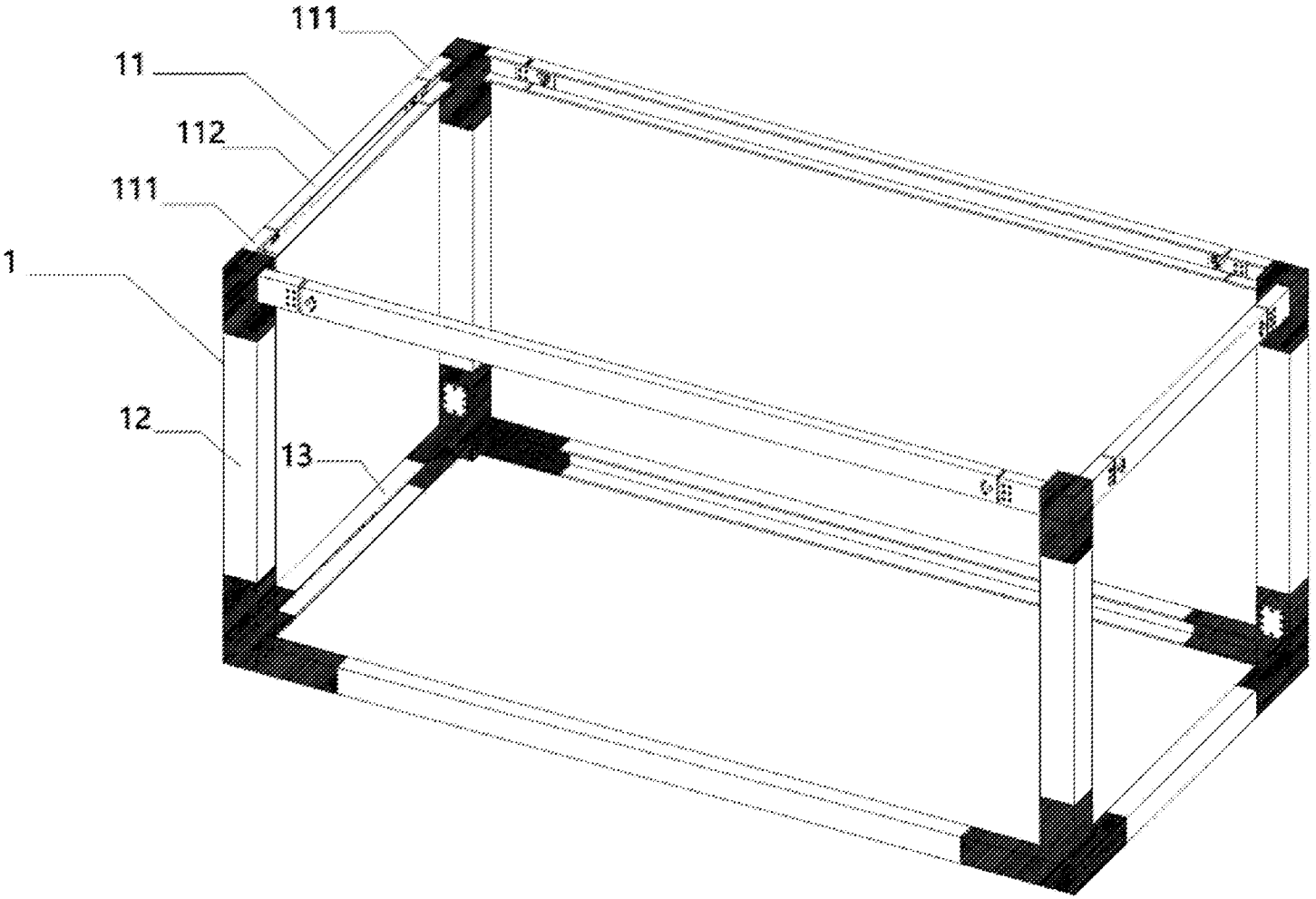
FIG. 14 is a schematic view of a building module (with the floor and the ceiling omitted)
Figure 15B:
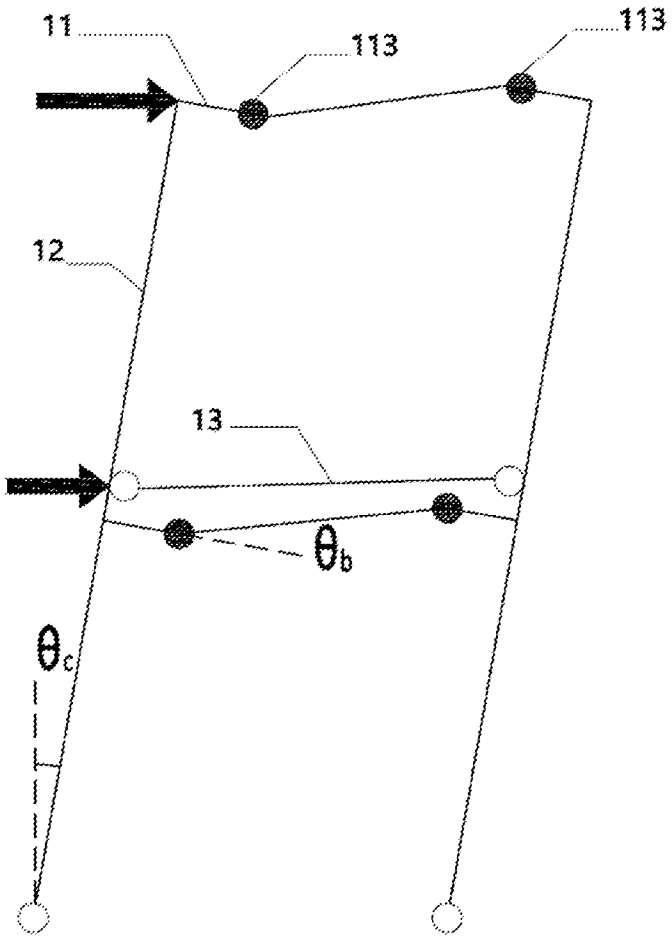
FIG. 15A-15B shows schematic views showing working of a ceiling beam rotational friction joint, where
Figure 15A:
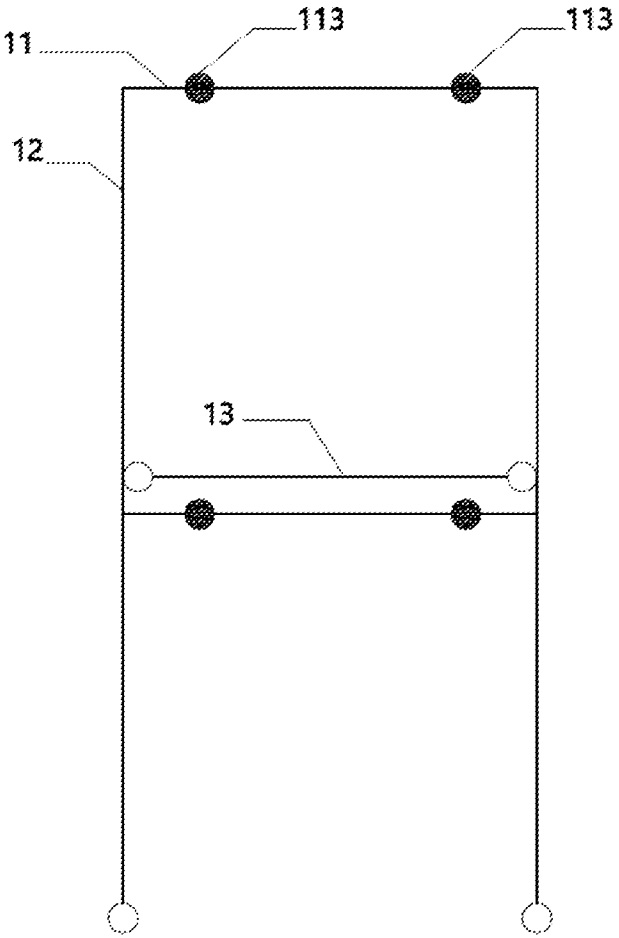
Figure 16B:
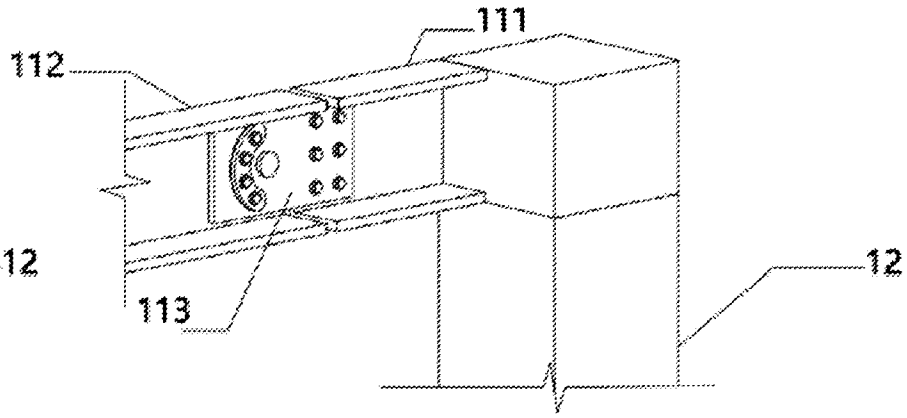
FIG. 16A-16B shows schematic structural views of a ceiling beam rotational friction joint, where
Figure 16A:
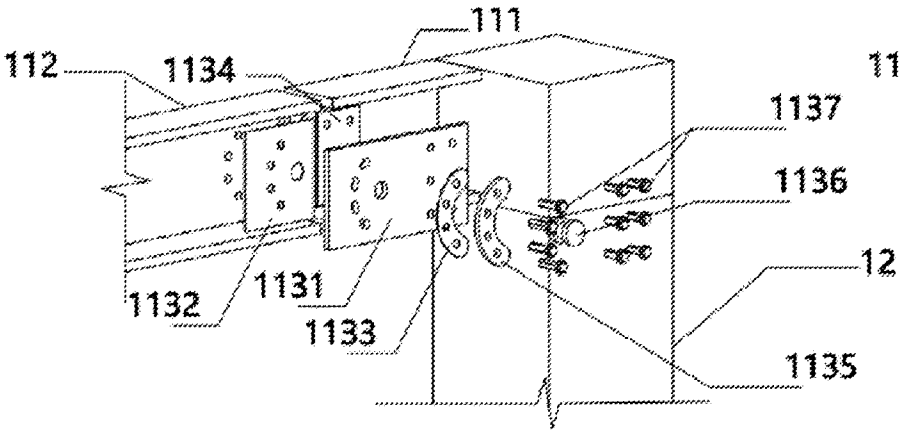
Figure 17B:
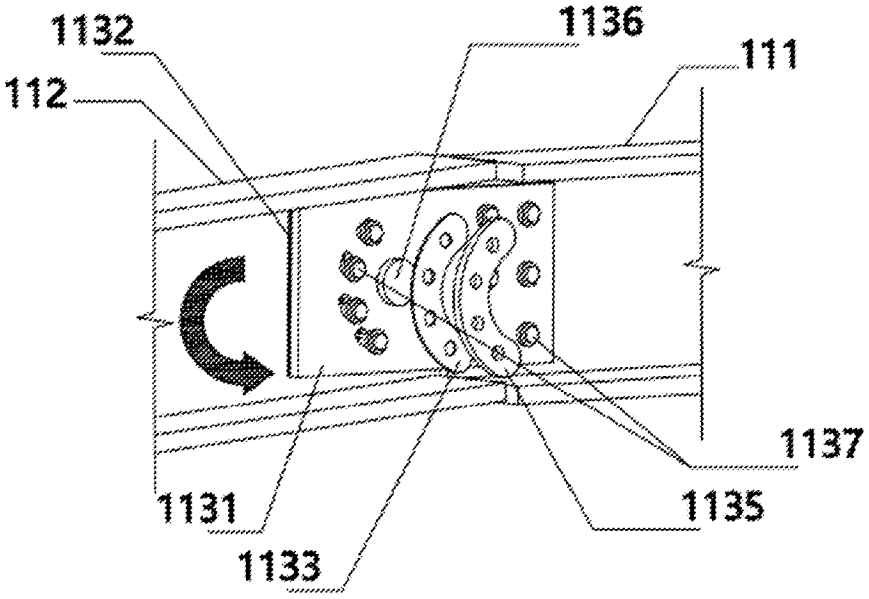
FIG. 17A-17B shows schematic views showing working of the ceiling beam rotational friction joint, where
Figure 17A:
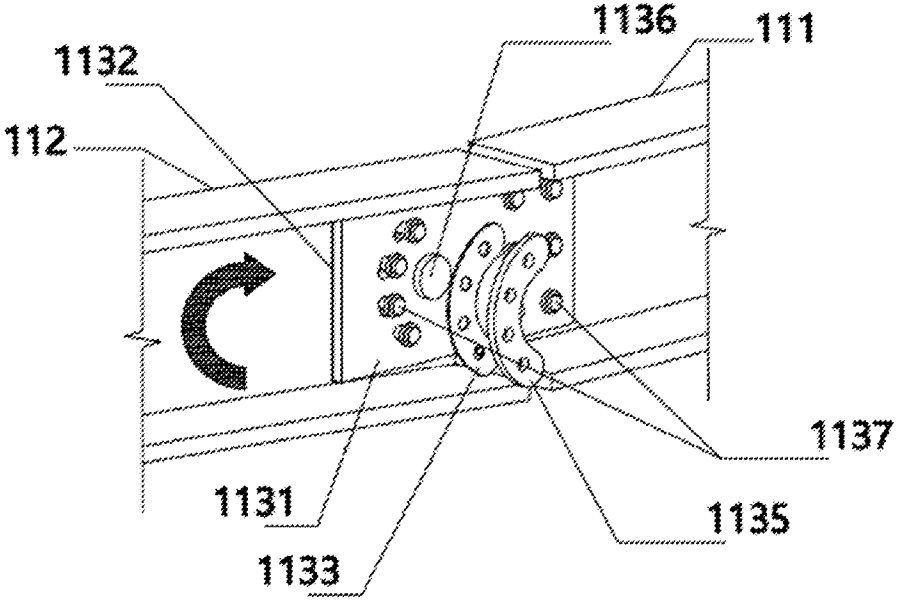
Figures 18A, 18B, 18C, 18D:
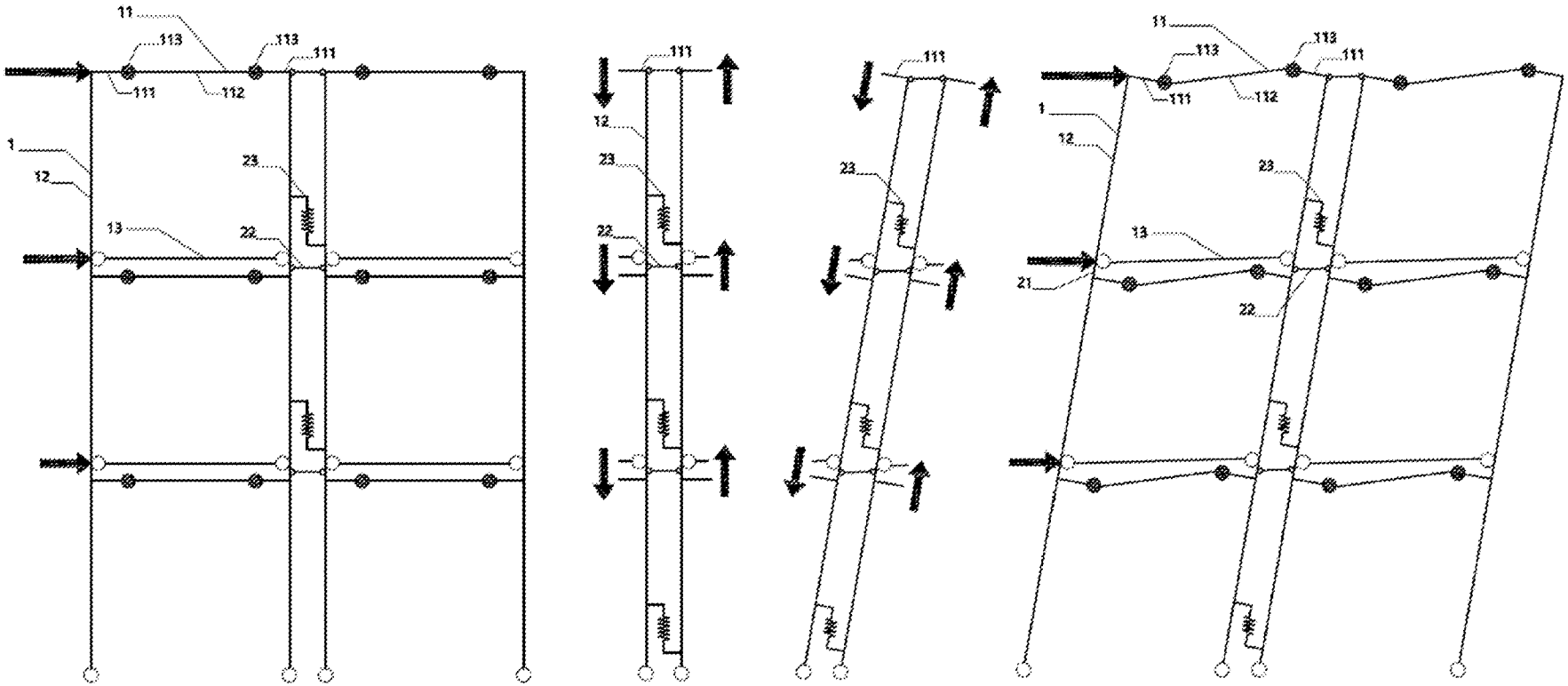
FIG. 18A-18D shows schematic diagrams of working principles of frictional connections between horizontal building modules, where

The building-integrated module 1 includes a plurality of building modules. Each building module mainly includes ceiling beams 11, local high-strength module columns 12 and local high-strength module bottom beams 13 located between the ceiling beams 11 and the local high-strength module columns 12. The ceiling beam 11 includes two cantilever beam sections 111 and a middle beam section 112 located between the two cantilever beam sections 111. The middle beam section 112 is connected to the two cantilever beam sections 111 through two ceiling beam rotational friction joints 113. Referring to FIG. 16A-16B, the ceiling beam rotational friction joint 113 specifically includes a beam connecting plate 1131, a first high friction surface 1132, a first low friction surface 1133, a beam connecting plate pad 1134, a sliding pad 1135, a pin 1136 and first pretensioners 1137. The cantilever beam section 111 of the ceiling beam 11 is welded with the local high-strength module column 12, and a web of the middle beam section 112 is connected to a web of the cantilever beam section 111 through the beam connecting plate 1131. The cantilever beam section 111 and the beam connecting plate 1131 are provided with circular holes at corresponding positions and connected through the first pretensioners 1137, and the beam connecting plate pad 1134 is sandwiched between the beam connecting plate 1131 and the cantilever beam section 111. The beam connecting plate 1131 and the middle beam section 112 are connected through the pin 1136. The middle beam section 112 is rotatable around the pin 1136. The first high friction surface 1132 is sandwiched between the beam connecting plate 1131 and the middle beam section 112. The sliding pad 1135 is arranged on the beam connecting plate 1131, and the first low friction surface 1133 is sandwiched between the sliding pad and the beam connecting plate. The first pretensioner 1137 is used to connect the sliding pad 1135, the first low friction surface 1133, the beam connecting plate 1131, the first high friction surface 1132 and the web of the middle beam section 112 and apply a pretension force. It should be noted that in some embodiments of the present invention, the beam connecting plate 1131 is provided with an arc-shaped slotted hole at a corresponding position, and the other plates are provided with circular holes. A web of the local high-strength module column 12 needs to be provided with an operation hole at a designed position, and slotted holes and circular holes for frictional connections for horizontal adjacent building modules.

In some embodiments of the present invention, the first pretensioner 1137 is a one-sided bolt.

Besides, in some embodiments of the present invention, the local high-strength module column 12 includes two high-strength steel column sections and an ordinary steel column section, which are welded together. The local high-strength module bottom beam 13 also includes two high-strength steel beam section and an ordinary steel column section, which are also welded together. The ceiling beams 11, the local high-strength module columns 12 and the local high-strength module bottom beams 13 are welded in a factory to complete the processing of the main structural components of the building-integrated module.

Figure 20B:
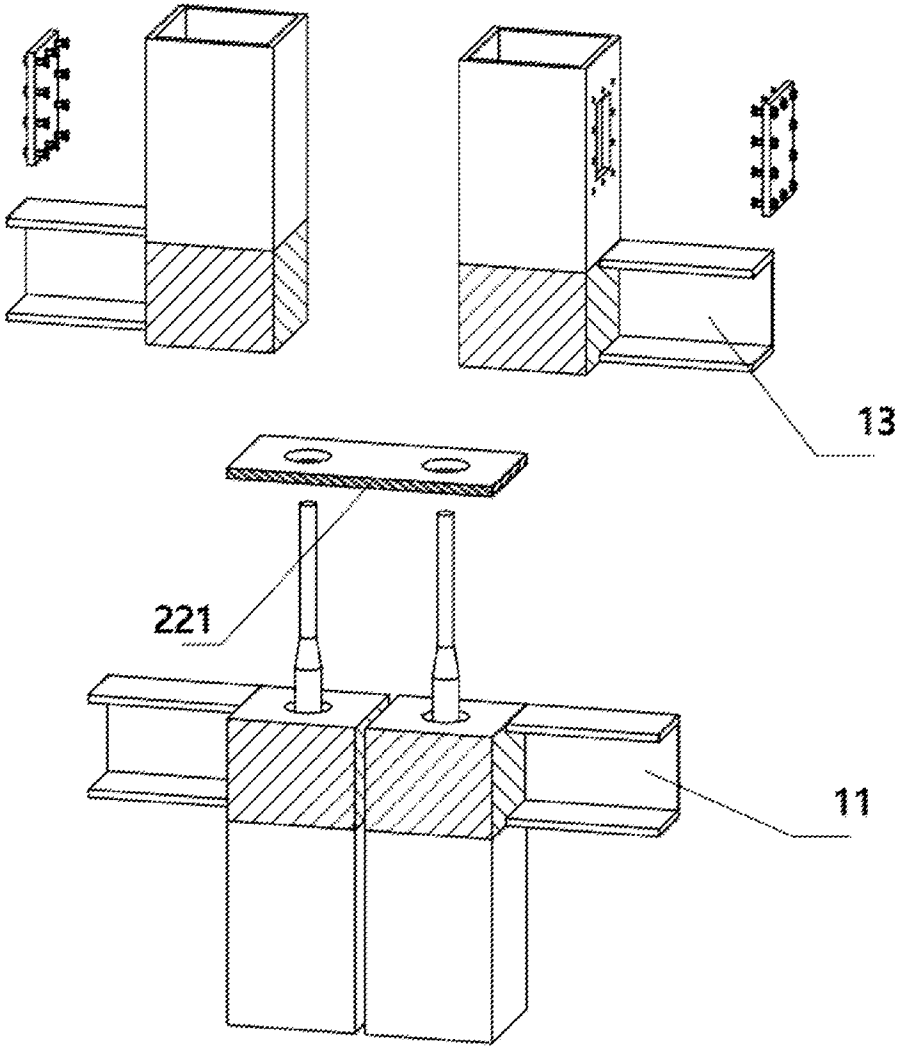
FIG. 20A-20B shows schematic views of a hinge joint between horizontal building modules, where
Figure 20A:
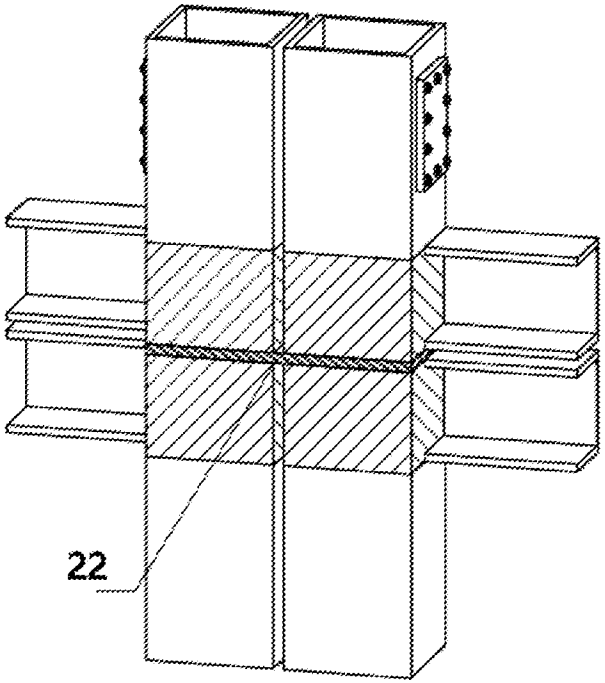
Figure 21C:
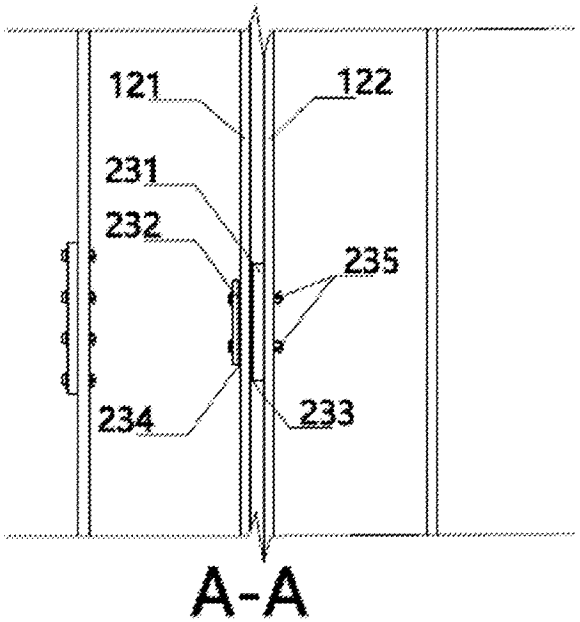
FIG. 21A-21C shows schematic views of a frictional connection between horizontal building modules, where
Figure 21B:
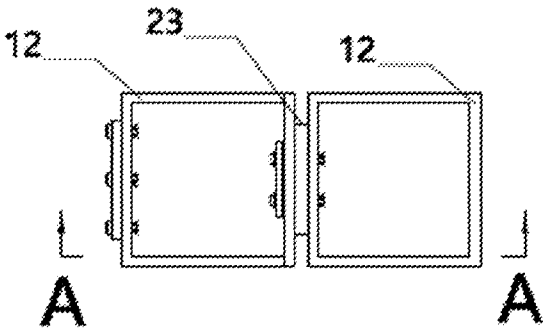
Figure 21A:
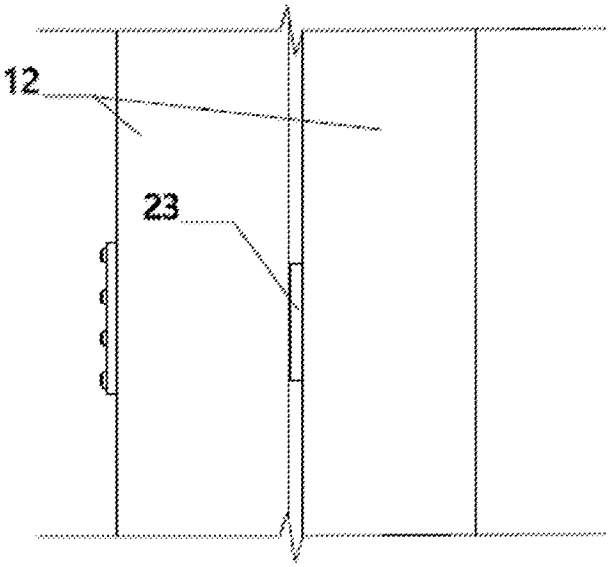
Figure 22B:
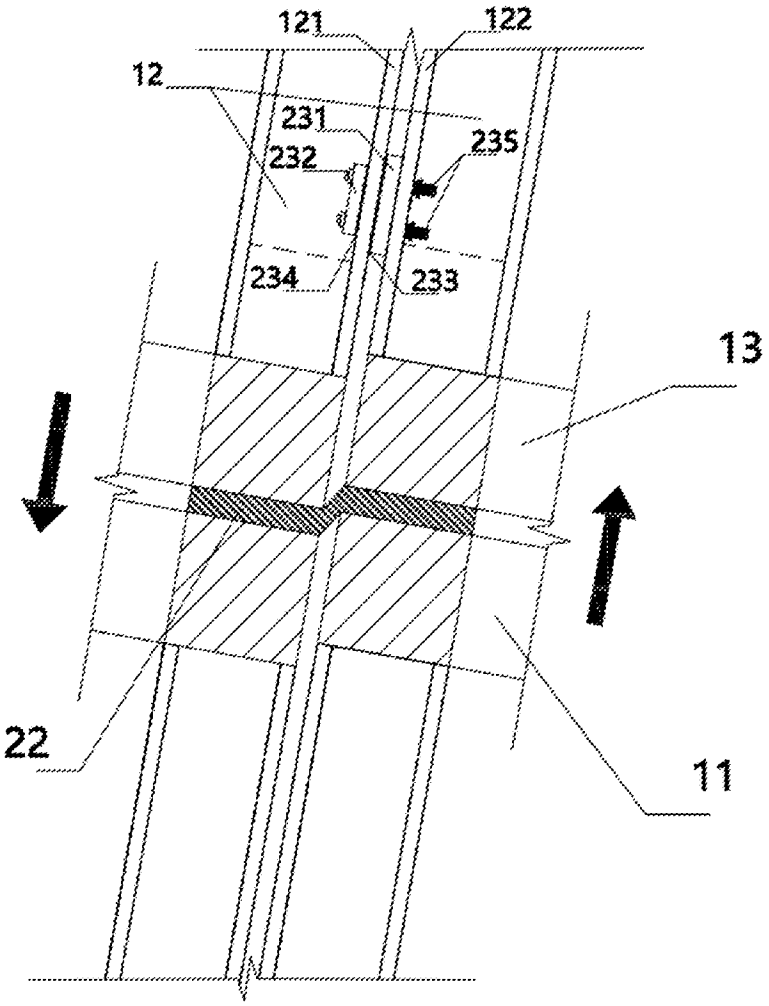
FIG. 22A-22B shows schematic views showing deformation of the frictional connection between horizontal building modules.
Figure 22A:
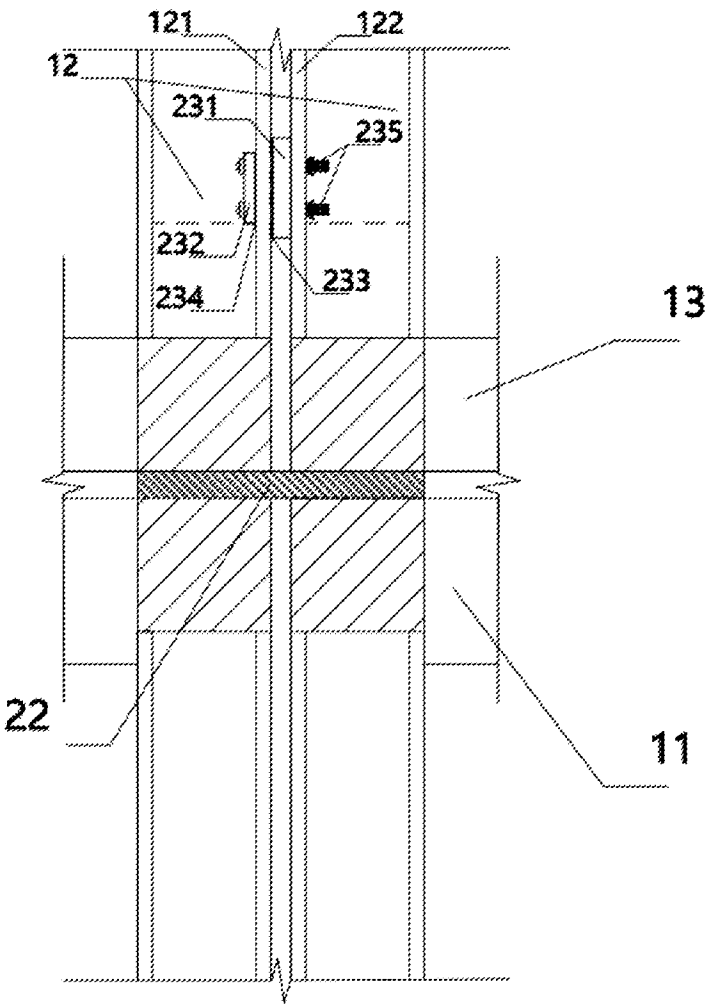

The connection joints between building modules include: vertical building module connection joints 21, hinge joints between horizontal building modules 22 and frictional connections between horizontal building modules 23. The vertical building module connection joints 21 and the hinge joints between horizontal building modules 22 can be realized by means of the existing related structures, including, but not limited to, tie rod shear lock connection joints shown in FIG. 19A-19C and FIG. 20A-20B. According to the vertical building module connection joint 21 shown in FIG. 19A-19C, upper and lower modules are connected through the tie rod shear lock 211, and a connecting plate is sandwiched between the upper and lower building modules. Two ends of the tie rod shear lock are respectively connected to the upper building module through an upper anchorage 212 and connected to the lower building module through a lower anchorage 213, so that the modules in the vertical direction are connected. As shown in FIG. 20A-20B, a common connecting plate 221 is arranged to connect the adjacent building modules in the horizontal direction, thereby realizing the hinge joint between horizontal building modules.

The main energy dissipating and seismic damping members in the connection joints between building modules are frictional connections between horizontal building modules 23. The frictional connection between horizontal building modules 23 specifically includes a pad between adjacent module columns 231, an in-column bolt pad 232, a second high friction surface 233, a second low friction surface 234 and second pretensioners 235. Webs of the two adjacent local high-strength module columns 12 of the two adjacent building modules in the horizontal direction are respectively defined as a first module column web 121 and a second module column web 122. The first module column web 121 provided with a slotted hole is adjacent to the second module column web 122 provided with a circular hole. The pad between columns 231 is sandwiched between two columns and welded with the second module column web 122 provided with the circular hole. The second high friction surface 233 is sandwiched between the pad between columns 231 and the first module column web 121 provided with the slotted hole. The in-column bolt pad 232 is arranged in the local high-strength module column provided with the slotted hole and is immediately adjacent to the slotted hole, and the second low friction surface 234 is arranged between the in-column bolt pad 232 and the first module column web 121 provided with the slotted hole. The second pretensioner 235 is used to sequentially pass through the in-column bolt pad 232, the second low friction surface 234, the first module column web 121 provided with the slotted hole, the second high friction surface 233, the pad between columns 231 and the second module column web 122 provided with the circular hole, and apply a pretension force. It should be noted that in some embodiments of the present invention, at one frictional connection between horizontal building modules 23, only the web of the module column 12 on one side is provided with the slotted hole, and the other plates are provided with circular holes.

In some embodiments of the present invention, the second pretensioner 235 is a one-sided bolt.

Based on the above, the structural system provided by the embodiments of the present invention can satisfy the following advantages required in engineering projects:

1. By means of reasonable design and reliable construction, the seismic damping design can be integrated into the ceiling beams of the building module. The ceiling beam rotational friction joints 113 are arranged as the energy dissipating and seismic damping members. Based on the characteristic that the members can produce rotational deformation under the action of a major earthquake, the friction force between the beam connecting plate 1131 and the web of the middle beam section 112 during the rotation is utilized to realize energy dissipation and seismic damping of the structure. By controlling the pretension force of the corresponding first pretensioner 1137, the level of internal force in the ceiling beam can be reasonably controlled, thereby ensuring these relatively weak members to keep elastic during the working process.
2. By means of reasonable design and reliable construction, the seismic damping design can be arranged in the inter-story between the adjacent building modules in the horizontal direction. The frictional connections between horizontal adjacent building modules 23 are arranged as the energy dissipating and seismic damping connections of the structure. Based on the characteristic that these connections can transfer part of the axial force of the column, the adjacent local high-strength module columns 12 can cooperatively bear forces under certain conditions, thereby effectively avoiding concentrated transfer of internal force of the structure in one vertical building module connection joint 21. When the structure enters the second seismic damping working state, based on the characteristic that these connections can slide axially along the local high-strength module column 12, the vertical constraints between the horizontal adjacent building modules are reasonably released, and the friction force between the first module column web 121 and the pad between columns 231 is utilized to realize energy dissipation and seismic damping. By controlling the pretension force of the corresponding second pretensioner 235, the level of transfer of the internal force of the frictional connection 23 is controlled, which can effectively prevent the vertical building module connection joint 21 from bearing excessive load and reasonably utilize the connection joints between building modules.
3. By means of reasonable design and reliable construction, the multiple seismic fortification lines are arranged for the modular steel structure. By adjusting the elastic load bearing capacity of the related energy dissipating and seismic damping members at different stages by means of adjusting the friction coefficient of the friction surface and the pretension force of the bolt, the ceiling beam rotational friction joints 113 and the frictional connections between horizontal adjacent building modules 23 enter the energy dissipating working state in batches, thereby realizing the reasonable arrangement of the multiple seismic fortification lines. By reasonably utilizing the changes in stiffness of the related energy dissipating and seismic damping members in the elastic state and the energy dissipating working state, the whole structure transforms from the earthquake-resistant system to the seismic damping system, thereby significantly reducing the energy input of the earthquake and effectively protecting the structure. Thus, the earthquake-resistant and seismic-damping multifunction structural system for a modular steel structure having multiple seismic fortification lines is formed.

The above description is only the preferred embodiments of the present invention and is not intended to limit the present invention. Any modifications, equivalent substitutions and improvements made within the spirit and scope of the present invention should be included within the protection scope of the present invention.

The invention claimed is:

1. An earthquake-resistant and seismic-damping multifunction cooperative system for a modular steel structure building, comprising a building-integrated module and connection joints between building modules, wherein the building-integrated module comprises a plurality of the building modules, each of the building modules comprising ceiling beams, module columns and module bottom beams, the ceiling beam comprising a middle beam section and cantilever beam sections located on both sides of the middle beam section, and each of the cantilever beam sections and the middle beam section being connected through a ceiling beam rotational friction joint; and the connection joints between the building modules comprise vertical building module connection joints, hinge joints between horizontal building modules and frictional connections between horizontal building modules, the adjacent building modules in a vertical direction being connected through the vertical building module connection joint, the adjacent building modules in a horizontal direction being hinged through the hinge joint between horizontal building modules to realize transfer of horizontal shear forces between the building modules and also connected through the frictional connection between horizontal building modules to provide vertical constraints, and the frictional connection between horizontal building modules being capable of moving axially relative to the module column.

2. The earthquake-resistant and seismic-damping multifunction cooperative system for the modular steel structure building according to claim 1, wherein the ceiling beams, the module columns and the module bottom beams each comprise high-strength steel sections.

3. The earthquake-resistant and seismic-damping multifunction cooperative system for the modular steel structure building according to claim 1, wherein the ceiling beam rotational friction joint comprises a beam connecting plate, a first surface, a sliding pad, a second surface and first pretensioners, wherein the beam connecting plate is rotatably connected to the middle beam section of the ceiling beam, and a web of the middle beam section is connected to a web of the cantilever beam section through the beam connecting plate;

the first surface is sandwiched between the beam connecting plate and the middle beam section;

the sliding pad is located on the beam connecting plate, and the second surface is sandwiched between the sliding pad and the beam connecting plate; and the first pretensioner sequentially connects the sliding pad, the second surface, the beam connecting plate, the first surface and the web of the middle beam section and is configured to apply a pretension force.

4. The earthquake-resistant and seismic-damping multifunction cooperative system for the modular steel structure building according to claim 3, wherein the ceiling beam rotational friction joint further comprises a pin, the beam connecting plate and the middle beam section being connected through the pin such that the middle beam section is rotatable around the pin.

5. The earthquake-resistant and seismic-damping multifunction cooperative system for the modular steel structure building according to claim 3, wherein the first pretensioner is a one-sided bolt.

6. The earthquake-resistant and seismic-damping multifunction cooperative system for the modular steel structure building according to claim 3, wherein the vertical building module connection joint connects vertical building modules by using a tie rod shear lock.

7. The earthquake-resistant and seismic-damping multifunction cooperative system for the modular steel structure building according to claim 6, wherein the hinge joint between horizontal building modules comprises a common connecting plate, the common connecting plate being configured to connect the adjacent building modules in the horizontal direction.

8. The earthquake-resistant and seismic-damping multifunction cooperative system for the modular steel structure building according to claim 3, wherein the ceiling beams, the module columns and the module bottom beams are welded in a factory.

9. The earthquake-resistant and seismic-damping multifunction cooperative system for the modular steel structure building according to claim 3, wherein the frictional connection between horizontal building modules comprises a pad between columns, an in-column bolt pad, a third surface, a fourth surface and second pretensioners;

webs of the two adjacent module columns of the two building modules in the horizontal direction are respectively defined as a first module column web and a second module column web, the first module column web being provided with a slotted hole, and the second module column web being provided with a circular hole;

the pad between columns is sandwiched between the first module column web and the second module column web, and the pad between columns is welded with the second module column web;

the third surface is sandwiched between the pad between columns and the first module column web;

the in-column bolt pad is located outside the first module column web, and the fourth surface is sandwiched between the in-column bolt pad and the first module column web; and the second pretensioner sequentially passes through the in-column bolt pad, the fourth surface, the slotted hole in the first module column web, the third surface, the pad between columns and the circular hole in the second module column web, and is configured to apply a pretension force.

10. The earthquake-resistant and seismic-damping multi-function cooperative system for the modular steel structure building according to claim 9, wherein the second pretensioner is a one-sided bolt.

11. The earthquake-resistant and seismic-damping multi-function cooperative system for the modular steel structure building according to claim 4, wherein the frictional connection between horizontal building modules comprises a pad between columns, an in-column bolt pad, a third surface, a fourth surface and second pretensioners;

webs of the two adjacent module columns of the two building modules in the horizontal direction are respectively defined as a first module column web and a second module column web, the first module column web being provided with a slotted hole, and the second module column web being provided with a circular hole;

the pad between columns is sandwiched between the first module column web and the second module column web, and the pad between columns is welded with the second module column web;

the third surface is sandwiched between the pad between columns and the first module column web;

the in-column bolt pad is located outside the first module column web, and the fourth surface is sandwiched between the in-column bolt pad and the first module column web; and the second pretensioner sequentially passes through the in-column bolt pad, the fourth surface, the slotted hole in the first module column web, the third surface, the pad between columns and the circular hole in the second module column web, and is configured to apply a pretension force.

12. The earthquake-resistant and seismic-damping multi-function cooperative system for the modular steel structure building according to claim 11, wherein the second pretensioner is a one-sided bolt.

13. The earthquake-resistant and seismic-damping multi-function cooperative system for the modular steel structure building according to claim 5, wherein the frictional connection between horizontal building modules comprises a pad between columns, an in-column bolt pad, a third surface, a fourth surface and second pretensioners;

webs of the two adjacent module columns of the two building modules in the horizontal direction are respectively defined as a first module column web and a second module column web, the first module column web being provided with a slotted hole, and the second module column web being provided with a circular hole;

the pad between columns is sandwiched between the first module column web and the second module column web, and the pad between columns is welded with the second module column web;

the third surface is sandwiched between the pad between columns and the first module column web;

the in-column bolt pad is located outside the first module column web, and the fourth surface is sandwiched between the in-column bolt pad and the first module column web; and the second pretensioner sequentially passes through the in-column bolt pad, the fourth surface, the slotted hole in the first module column web, the third surface, the pad between columns and the circular hole in the second module column web, and is configured to apply a pretension force.

14. The earthquake-resistant and seismic-damping multi-function cooperative system for the modular steel structure building according to claim 6, wherein the frictional connection between horizontal building modules comprises a pad between columns, an in-column bolt pad, a third surface, a fourth surface and second pretensioners;

webs of the two adjacent module columns of the two building modules in the horizontal direction are respectively defined as a first module column web and a second module column web, the first module column web being provided with a slotted hole, and the second module column web being provided with a circular hole;

the pad between columns is sandwiched between the first module column web and the second module column web, and the pad between columns is welded with the second module column web;

the third surface is sandwiched between the pad between columns and the first module column web;

the in-column bolt pad is located outside the first module column web, and the fourth surface is sandwiched between the in-column bolt pad and the first module column web; and the second pretensioner sequentially passes through the in-column bolt pad, the fourth surface, the slotted hole in the first module column web, the third surface, the pad between columns and the circular hole in the second module column web, and is configured to apply a pretension force.

15. The earthquake-resistant and seismic-damping multi-function cooperative system for the modular steel structure building according to claim 7, wherein the frictional connection between horizontal building modules comprises a pad between columns, an in-column bolt pad, a third surface, a fourth surface and second pretensioners;

webs of the two adjacent module columns of the two building modules in the horizontal direction are respectively defined as a first module column web and a second module column web, the first module column web being provided with a slotted hole, and the second module column web being provided with a circular hole;

the pad between columns is sandwiched between the first module column web and the second module column web, and the pad between columns is welded with the second module column web;

the third surface is sandwiched between the pad between columns and the first module column web;

the in-column bolt pad is located outside the first module column web, and the fourth surface is sandwiched between the in-column bolt pad and the first module column web; and the second pretensioner sequentially passes through the in-column bolt pad, the fourth surface, the slotted hole in the first module column web, the third surface, the pad between columns and the circular hole in the second module column web, and is configured to apply a pretension force.

16. The earthquake-resistant and seismic-damping multi-function cooperative system for the modular steel structure building according to claim 8, wherein the frictional connection between horizontal building modules comprises a pad between columns, an in-column bolt pad, a third surface, a fourth surface and second pretensioners;

webs of the two adjacent module columns of the two building modules in the horizontal direction are respectively defined as a first module column web and a second module column web, the first module column web being provided with a slotted hole, and the second module column web being provided with a circular hole;

the pad between columns is sandwiched between the first module column web and the second module column web, and the pad between columns is welded with the second module column web;

the third surface is sandwiched between the pad between columns and the first module column web;

the in-column bolt pad is located outside the first module column web, and the fourth surface is sandwiched between the in-column bolt pad and the first module column web; and the second pretensioner sequentially passes through the in-column bolt pad, the fourth surface, the slotted hole in the first module column web, the third surface, the pad between columns and the circular hole in the second module column web, and is configured to apply a pretension force.

* * * * *